US009883550B2

(12) United States Patent
Comoglio et al.

(10) Patent No.: US 9,883,550 B2
(45) Date of Patent: Jan. 30, 2018

(54) MULTILAYER TEXTILE ARTICLE WITH AN INNER HEATING LAYER MADE OF AN ELECTRIFIED FABRIC, AND RESPECTIVE MANUFACTURING PROCESS

(71) Applicant: COFILEA SRL UNINOMINALE, Biella (IT)

(72) Inventors: Ezio Comoglio, Donato (IT); Lorenzo Comoglio, Donato (IT)

(73) Assignee: COFILEA SRL UNINOMINALE, Biella (IT)

( * ) Notice: Subject to any disclaimer, the term of this patent is extended or adjusted under 35 U.S.C. 154(b) by 0 days.

(21) Appl. No.: 15/033,888

(22) PCT Filed: Nov. 4, 2014

(86) PCT No.: PCT/IT2014/000286
§ 371 (c)(1),
(2) Date: May 2, 2016

(87) PCT Pub. No.: WO2015/068181
PCT Pub. Date: May 14, 2015

(65) Prior Publication Data

US 2016/0270158 A1 Sep. 15, 2016

(30) Foreign Application Priority Data

Nov. 5, 2013 (IT) ..... BI2013A0013

(51) Int. Cl.
*H05B 3/34* (2006.01)
*H05B 3/36* (2006.01)
(Continued)

(52) U.S. Cl.
CPC ..... *H05B 3/36* (2013.01); *H05B 1/0272* (2013.01); *H05B 3/145* (2013.01); *H05B 3/342* (2013.01);
(Continued)

(58) Field of Classification Search
CPC ..... H05B 3/145; H05B 3/342; H05B 3/36; H05B 1/0272; H05B 2203/011; H05B 2203/026; H05B 2203/015
(Continued)

(56) References Cited

U.S. PATENT DOCUMENTS 4,983,814 A * 1/1991 Ohgushi ..... D02G 3/441 219/212
2002/0153368 A1* 10/2002 Gardner ..... B29C 70/82 219/545
(Continued)

FOREIGN PATENT DOCUMENTS

EP 0 505 936 A2 9/1992
EP 1460159 B1 9/2004
(Continued)

OTHER PUBLICATIONS

International Search Report for International Application No. PCT/IT2014/000286 filed on Nov. 4, 2014 in the name of Cofilea SRL Uninominale. dated Mar. 17, 2015.
(Continued)

*Primary Examiner* — Thien S Tran
(74) *Attorney, Agent, or Firm* — Steinfl + Bruno LLP

(57) ABSTRACT

A textile article, in form of a heating multilayer fabric, including a textile heating layer associated with an electrical resistance adapted to be powered with an electric current for generating heat, and a reflective layer arranged adjacent to the heating layer to receive and reflect to a front side of the textile article the heat generated by the heating layer. The heating layer is made from a fabric that incorporates in its textile structure, as electrical resistance for heat generation, a yarn, in form of a serpentine, consisting of carbon fibers. The fabric of the heating layer is a special fabric made by a warp knitting machine or loom of the "crochet" type, using the yarn of carbon fibers as effect yarn to realize in the fabric
(Continued)

the serpentine design of the electrical resistance intended to warm up.

18 Claims, 10 Drawing Sheets

(51) Int. Cl.
*H05B 3/14* (2006.01)
*H05B 1/02* (2006.01)

(52) U.S. Cl.
CPC .. *H05B 2203/011* (2013.01); *H05B 2203/015* (2013.01); *H05B 2203/026* (2013.01)

(58) Field of Classification Search
USPC .... 219/203, 211, 217, 529, 549; 428/87, 88, 428/97, 220
See application file for complete search history.

(56) References Cited

U.S. PATENT DOCUMENTS

2003/0052114 A1* 3/2003 Ek ..... H05B 3/36 219/213
2003/0102296 A1 6/2003 Nelson et al.
2006/0052849 A1* 3/2006 Docherty ..... A61F 7/007 607/100
2007/0056957 A1* 3/2007 Diemer ..... B60N 2/5685 219/549
2010/0126981 A1* 5/2010 Heintz ..... C08F 259/08 219/482
2011/0297667 A1 12/2011 Kunisada
2012/0100386 A1* 4/2012 Honma ..... D02G 3/32 428/592

FOREIGN PATENT DOCUMENTS

EP 1 536 669 A2 6/2005
EP 2 608 630 A1 6/2013
WO 00/19773 A1 4/2000
WO 2006/054853 A1 5/2006

OTHER PUBLICATIONS

Written Opinion for International Application No. PCT/IT2014/000286 filed on Nov. 4, 2014 in the name of Cofilea SRL Uninominale. dated Mar. 17, 2015.
International Preliminary Report on Patentability for International Application No. PCT/IT2014/000286 filed on Nov. 4, 2014 in the name of Cofilea SRL Uninominale. dated Oct. 13, 2015.

* cited by examiner

MULTILAYER TEXTILE ARTICLE WITH AN INNER HEATING LAYER MADE OF AN ELECTRIFIED FABRIC, AND RESPECTIVE MANUFACTURING PROCESS

CROSS REFERENCE TO RELATED APPLICATIONS

The present application is the U.S. national stage entry of International Application PCT/IT2014/000286 filed on Nov. 4, 2014 which, in turn, claims priority to Italian Application No. BI2013A000013 filed on Nov. 5, 2013.

FIELD OF THE INVENTION

The present invention relates in general to the sector of textile articles for uses and special applications, and more particularly it relates to a textile article in the form of a multilayer sheet or fabric having heating capacity, i.e. capable of generating heat, conferred by a heating layer in turn consisting of a fabric, electrified, integrated in the multilayer structure of the same textile article.

The present invention also relates to a corresponding process for manufacturing a textile article, with heating capacity, in the form of a multilayer sheet or fabric that incorporates in its multilayer structure a layer made from an electrified fabric.

GENERAL STATE OF THE PRIOR ART

In the present technique there are known various articles, in the form of a sheet or a woven fabric having a multilayer structure that is composed of a plurality of stacked layers, wherein these articles exhibit heating capacity.

In particular there are known woven articles having a multilayer structure, as well as articles having a similar configuration, which include, between their layers, a specific heating layer, consisting of a fabric or realized in other forms, which incorporates an electrical resistance, for example constituted by a sheet of conductive material, wherein such resistance in turn is fed with an electric current so as to warm up for joule effect, as well known, and therefore generate heat that is transmitted at the outside of the article.

These known multilayer textile articles, including as said one heating electrified inner layer, can assume the most varied forms and be used in a wide range of applications.

For example, these items or articles can be used to manufacture thermal blankets, or for covering floors so as to realize a heating floor, or to realize anti-frost systems or still for other applications, as well known to the experts in the sector.

However these known articles and items exhibiting heating capacity, despite their availability and use in the market for a long time, are not free from limitations and drawbacks, so as to require to be further improved in their characteristics and performances.

For instance, it is required that these articles and items have an energy efficiency, i.e. a conversion capacity of the electrical energy with which they are fed in heat transmitted to the outside of the article, which is the highest possible, together with manufacturing and installation costs of the article that are reduced as much as possible, so as to meet the needs of the market that requires products and articles ever more efficient and less expensive.

Furthermore, in terms of costs, a critical point of these known heating articles is represented by the fact that the integration, in the heating layer, of the electrical resistance intended to be supplied with an electric current in order to generate heat, greatly affects the final cost of the article, since this integration is usually realized with operations, for example by mechanical binding, rather expensive from an industrial point of view, and in certain cases even in manual mode, by sewing.

Therefore, in order to reduce the manufacturing cost of these textile multilayer articles, there is a need to find solutions that allow to optimize and reduce the cost of manufacture of the respective heating layers integrating the electrical resistance.

General Information about the Various Technologies of Knitting, in Particular Warp Knitting of the Crochet Type, Defining the Context of the Present Invention As illustrated and explained in detail below, the textile article of the invention is manufactured using a special knitted fabric, of the so-called "crochet" type, made with a specific technology of warp knitting and using specific knitting machines or looms, precisely of the crochet type.

Therefore, in order to frame the present invention as clearly and fully as possible and define the proper context in which it was developed, there will be provided in the following some preliminary information concerning both the various technologies of knitting, currently known and in use, and the manufacture of the knitted fabrics of the "crochet" type and other similar fabrics of possible interest.

First, it is necessary to point out that knitting can be realized both in warp and in weft.

Now, since warp knitting, also called chain knitting, is the one that relates more closely to the present invention, there will be provided in the following some more specific and precise information about it.

In particular, as shown on the following page of the Internet Encyclopedia Britannica:

http://www.britannica.com/EBchecked/topic/589392/textile/15831/Warp-knitting, the warp knitting can be of two types, respectively of the type "raschel", made with latch needles, or of the type "tricot", made with needles exhibiting at the tip a sort of beard, and for this reason also called "bearded needles".

Raschel Warp Knitting

The machines for warp knitting of the raschel type are generally used to produce knitted fabrics with coarse yarns, although recently there has been a certain interest for the use of these machines with finer yarns and staple fibers, for example wool and cotton.

These knitting machine of the raschel type are suitable to manufacture, like all the knitting machines or looms, a knitted fabric that exhibits a plurality of adjacent loops, in turn formed by the yarns which feed the machine, and, for this purpose, comprise a system of needles that are moving up and down in a base plate of steel, also called trick plate, and that receive the yarns to form the loops.

In particular the top, i.e. the "verge", of this base plate, defines the level at which the completed yarn loops are formed on the shank of each needle.

Furthermore, the loops are prevented from moving upwards, when the needle raises, due to the pull exerted downwards by the fabric and by elements, called sinkers, associated with the needles.

The yarns are in turn fed to the needles by guide bars.

In the execution of a knitting cycle, in these raschel machines, needles initially start from the lowest point of their stroke, when the preceding loop, already formed, has just been cast off, and the new loop joins the hook of the needle to the fabric.

Then the needles rise, while the new loop opens the latch and ends up on the shank of the needle below this latch.

Simultaneously the guide bars that feed the yarns swing through the needles and the front bar moves one needle space sideways.

In this phase, when the guide bar swings back to the front of the machine, the front bar has already laid the yarn on the hooks of the needles.

Then the needles fall, whereby the earlier loops, i.e. those formed more recently, close the latch to trap the new loops, while the old loops are cast off.

The raschel knitting machines or looms are made in a variety of forms and usually have a more open construction as well as a coarser texture than other knitting machines.

A knitting machine of the raschel type and the respective parts are for example described by patent EP 1460159 B1.

Tricot Warp Knitting

The fabric produced with this type of warp knitting is usually made with two sets of yarns and is characterized by thin ribs which run vertically on the front face of the fabric and horizontally on its back.

The tricot warp knitting machine makes light fabrics, weighing less than four ounces per square yard.

Its development was stimulated by the invention of the so-called FNF compound needle, a sturdy device that is now obsolete, but which made possible a significant improvement of the speed of production.

Although currently about half of the tricot machines are currently used to manufacture plain fabrics on two guide bars, there is a growing interest for the manufacture of knitted fabrics with patterns.

In particular, in this type of knitting, the warp-knitting cycle requires a close and precise control of the movement of the side bar, achieved by using control chains made of chunky metal links.

Special Effects in Warp Knitting

The applications and benefits of warp knitting have been extended in time by the development of procedures and machines that have allowed the insertion of yarns in a manner different from those that were typical of traditional weaving and knitting, for example to obtain color effects, inlays, zones of different yarn density in the fabric, wherein these yarns can be integrated and essential part of the textile structure of the knitted fabric.

For example, in the form of warp knitting called "zigzagging across several pillars", which is the basis of most raschel knitted fabrics, the front bar of the knitting machine form "crochet" chains, or "pillars", which are connected by zigzag inlays.

An interesting extension and variant of the warp knitting is also that which is realized with the so-called Co-We-Nit machine for warp knitting, suitable to produce fabrics having the appearance both of a woven cloth and of a knitted fabric.

In this variant, the respective knitting machines need to have only two warp-forming yarns and provision for up to eight interlooped warp yarns between each chain of loops, with these warp yarns being interlaced with a quasi-weft yarn, so as to form a fabric resembling a woven cloth on one side.

In summary warp knitting, often also generically called raschel knitting, includes various specific embodiments, in which it can exhibit the typical appearance of a usual weft and warp weaving, and in particular comprises the crochet warp knitting or simply crochet knitting, by which it is manufactured the fabric, justly called crochet fabric, used to make the textile article according to this invention.

Crochet Knitting Machine or Crochet Machine

Again in order to define in a clear and precise the context of the present invention and fully appreciate its innovative features in relation to the known technique, there will be provided in the following, with reference to FIG. 9, in turn corresponding to the following page of the internet:

textilelearner.blogspot.it/2012/03/crochet-macchina-maglieria-elementi-of.html, some more precise and detailed information concerning a typical warp knitting machine of the crochet type, also called simply crochet machine, similar to that used to make the heating fabric that is included and essential part of the fabric of the invention, as described hereinafter in detail.

While in the classic hand crocheting, a hook is used to form and draw a new loop through the old loop with the chains of loops being joined together at intervals along the chains of loops that are gradually formed, in a crochet machine the chains of loops formed by the warp yarns are separated from the weft inlay that join the chaining wales to each other.

In detail, as shown schematically in FIG. 9, the essential elements of a typical crochet knitting machine, indicated as a whole with MC, comprise at least a single horizontal needle bar, indicated by A, which is simply animated to reciprocate forward and back, as indicated by a double arrow f1, so as to actuate a plurality of latch needles, or a plurality of embroidery needles, individually indicated with B and each defining at the tip a hook B', wherein the needles B are associated with a base plate or trick plate P.

For example a needle B, such as that shown in FIG. 9, is used for the realization of fine articles and textile structures and has at the tip, over the hook B', also a sort of a sideways crimped beard, indicated with B", which is placed in a permanently pressed position.

Although warp threads can be fed to this beard B" only from the left, as shown in FIG. 9, so as to imply a cyclic unidirectional overlap of warps on the needle B, the old overlaps of warps on the needle are automatically cleared and landed by the same forward and backward movement of the needle, as described hereinafter.

This type of needle B is still the most frequently used in applications in which it can reach speeds up to 2500 cycles per minute.

The reduced speed of the machine and the high wear of the needles makes the use of a crochet machine uneconomical for knitting individual cotton threads.

Unlike other knitting machines, the crochet machine MC does not include sinkers or similar elements, but instead a fixed hold-back or guide bar, indicated with G, which is fitted in front of the top of the base plate P, i.e. the verge, so as to hold and prevent the knitted fabric T moving out with the needles and escape from them.

Moreover, as shown in FIG. 9, in the crochet machine MC the weft yarns indicated with Y1 and the warp yarns indicated with Y2 constitute two distinct groups of yarns that are supplied and controlled separately to turn the warp yarns Y2 around the needles B and to insert the weft yarns Y1, so as to form the stitches or loops N of the knitted fabric T that is produced with the crochet machine MC.

Each needle B is lapped from below by its own warp guide C, in the form of an eyelet, which is adapted to receive and guide a respective warp yarn Y2.

This warp guide C in turn is clipped to a warp guide bar, not shown in FIG. 9, which is moved by an eccentric cam so as to overlap and retract with an automatic movement the warp guide C with respect to the needle B, as indicated by a double arrow f2 in FIG. 9, and is also controlled by a rocker-shaft system so as to swing upwards and downwards the same warp guide C always relative to the needle B, as indicated by a double arrow f3 sill in FIG. 9.

Also a bending bar or plaiting bar D is provided to bend in a controlled manner the warp yarns, while they are being moved by the guide warp C, in order to correctly form the loops N of the knitted fabric T.

The warp yarns Y2 are usually placed low at the front of the crochet machine, while the weft yarns Y1 are often arranged in the upper part towards the back of the crochet machine MC.

The weft yarns Y1 are suitable to be fed from the top to carrier tubes E that are clipped to insertion or design bars F, positioned above the needle bars A.

These design bars F in turn are cyclically controlled and moved, to the rhythm of a stroke at each cycle, from tracks, defining the pattern or design to be implemented in the knitted fabric T, which are provided around a drum placed at one end of the crochet machine.

A usual crochet knitting machine may comprise up to two needle bars A for the warp threads and up to sixteen design bars F for the weft threads, wherein both needle bars and design bars can be controlled electronically.

The crochet machine MC again comprises a system of output rollers, indicated with H, suitable to withdraw and convey the knitted fabric T, once formed, to the exit of the crochet machine MC.

There are also special arrangements of these crochet machines for producing fabrics with fancy effects, such as cut or uncut fringe edges, pile, braiding and snail shell designs.

The crochet machines, due to their simple construction and the ability to easily change the design and the width of the article that is produced and to use individual bobbins or beams, offer the opportunity to handle small requests of articles, such as tapes and fancy edgings of high or low quality, and also allow the specialized production of wide fancy fabrics or of narrow elastic laces.

Specific Patent Documents Reflecting the Known Technique

Always in order to properly contextualize the present invention and therefore allow to fully appreciate its innovative features there will be mentioned and briefly commented in the following some patent documents that reflect the prior art at the time of filing of this patent application.

First, patent document WO 2006/054853 A1 describes a heating fabric and a corresponding manufacturing method, wherein the heating fabric comprises a main heating part, adapted to heat up electrically, in turn constituted by a fabric of the weft-warp type realized with a conventional textile shuttle loom, and a pair of electrically conductive bands, separated from each other, which extend along a lateral edge of the heating fabric, to the side of the respective main heating part, wherein this pair of lateral conductive bands are formed by conductive warp yarns and define two electrodes for the power supply of the main heating part.

The main heating part, adapted to heat up electrically, of this fabric known from document WO 2006/054853 A1, is made, by means of the shuttle loom, by inserting in an intermittent manner in the fabric a heating weft yarn or thread, consisting of conductive fibers, in particular carbon, adapted to heat up electrically, so as to exhibit, in the final fabric that is produced, a given design, for example according to a zig-zag pattern, defined by this heating weft yarn, that is adapted to be supplied with an electric current through the conductive bands, operating as electrodes, formed along the lateral edge of the main heating part, so as to generate heat and warm up.

One end of the weft threads which define the heating pattern made in the main heating part is woven so as to be part and connected with a first one of the two conductive side bands, while the other end of these heating weft threads is not woven with the other yarns, but includes a portion that crosses the first conductive band to connect with the second conductive band.

Both the conductive side bands, operating as electrodes, and the zig-zag configuration of the heating yarns are formed on a common face of the heating fabric so as to reduce the electromagnetic radiations emitted from the fabric.

As specified before, the loom or textile machine used to manufacture this heating fabric, known from WO 2006/054853 A1, is a classic and traditional shuttle, also called shuttle loom, adapted to produce a plain fabric typically consisting of weft yarns and warp yarns.

It follows that this heating fabric, known from WO 2006/054853 A1, exhibits both a configuration and characteristics and performance that are limited by the fact that the fabric is made using a traditional shuttle loom, but the same applies even if it were manufactured with a shuttleless loom, for example of the rapier or grip pr air type.

In particular, due to the limitations and lack of versatility of these traditional shuttle looms, but also of those without shuttle, also usually called shuttleless looms, the realization, in this known heating fabric, of the conductive side bands operating as electrodes for supplying the electrically conductive yarns of the heating fabric, is rather complex and expensive, as before illustrated.

Moreover, also the realization, in this heating fabric known from WO 2006/054853 A1 and manufactured by means of a conventional textile shuttle loom, of the design with the conductive weft yarns imply relevant limits, whereby not all of the desired design configurations are possible, as also further explained in the following.

Patent WO00/19773 A1 in turn describes a heating article, typically in sheet form, which includes and incorporates a heating part or core consisting for example of conductive strips or similar elements, suitable to heat and electrically generate heat.

These conductive strips in turn may be formed by conductive yarns, carbon yarns coated with a metal, or metal wires, electrically insulated from each other, which are woven together with non-conductive yarns, or laminated between insulating non-conductive layers, and are arranged and incorporated in the heating sheet according to a particular design or model, for example in a zig-zag pattern, corresponding to the type and characteristics of the heating to be obtained with the heating sheet.

The article includes still conductors in form of electrodes, for the electrical supply, which extend along the sheet and to which there are connected in series or in parallel the elements of the heating core.

It is noted, however, that the heating article, in the form of sheet, as described by this patent document involves a respective fabrication process which is quite complex, and for example includes specific and laborious steps to apply and incorporate in the article, according to the desired design, the elements, such as the conductive strips, of the heating core.

Furthermore, the same heating article is affected by relevant limits to obtain and realized all the desired designs of the heating core.

Still patent EP 0505936 A2 describes a warm-up wrap to be used to wrap and pre-heat the tires of racing cars immediately before the start of a race, wherein this warm-up wrap includes a heating fabric of the warp and weft type, adapted to heat electrically and produce heat, which is formed by warp yarns including electrically conductive yarns consisting of a mixture of conductive metal fibers and staple fibers, non-conductive, and by weft threads consisting of yarns composed of non-conductive fibers.

Moreover the heating fabric of this warm-up wrap exhibits in both side end portions a plurality of weft yarns, constituted by metal wires, which are divided into a plurality of electrodes, wherein these electrodes form with the electrically conductive yarns included in the warp a series of electric circuits which extend forward and backward alternately along the length of the fabric.

However this warm-up wrap with heating fabric, known from EP 0535936 A2, is not free from limitations and drawbacks and in particular has a use restricted to the pre-heating of tires, as well as a construction rather complex and expensive to achieve the side electrodes for the power supply of the heating circuits defined by the conductive yarns included in the fabric.

Also this warm-up wrap, being produced with a conventional linear textile loom of the warp and weft type, exhibits relevant limitations as regards the possibility to be made with the desired configurations of the elements and the heating wires that are included in the fabric.

SUMMARY OF THE INVENTION

Therefore a primary object of the present invention is to propose and implement a new and innovative textile heating article, typically in the form of a sheet having a multilayer structure, which implies significant improvements compared to the textile heating articles of this type, as well as to similar products, already known and currently in use, such as those illustrated before, and in particular implies a better and more efficient generation, distribution and transmission to the outside of the heat that is generated by warming up the textile article.

A second object of the present invention is also to propose and implement a new and innovative heating textile article, in the form of a sheet having a multilayer structure, including a specific heating layer in turn incorporating an electrical resistance typically in a thread-like form, i.e. filiform, wherein this specific heating layer is realizable at a limited industrial cost and in a versatile way as regards the design of the filiform electrical resistance which is integrated in the same heating layer, with positive effects on the total cost of the entire multilayer article, so as to overcome and remedy the limits and the drawbacks of the known technique in which the electrical resistance is usually integrated and fixed in the respective heating layer with expensive operations, for example by tying, and/or involving the use of additional fixing clamps.

A third object of the present invention is also to provide a multilayer heating article of the type including at least one layer consisting of a heating fabric, in turn integrating a heating conductive wire or yarn which defines an electrical resistance adapted to generate heat, wherein this heating wire can be powered directly from the mains, without requesting side conductive bands or similar electrodes, as in the heating fabrics of the prior art, which greatly complicate the construction of the heating fabric and significantly increase its cost.

A further fourth object, however connected to the preceding ones, of the present invention is also to propose a new, innovative and versatile heating textile article, in the form of sheet with a multilayer structure, which is adapted to be advantageously applied, with limited costs, in a wide range of situations and operational applications, for instance ranging from the application of the article as heating coating of floors to the inner lining of clothing such as jackets or other similar items, and even to as heating sheet included between the parts which constitute a thermal curtain or a similar article.

The above objects can be considered fully achieved by the new multilayer textile article with heating capacity having the characteristics defined by the first main independent claim.

Special forms of realization of the new multilayer heating textile article are also defined by the dependent claims.

ADVANTAGES AND USES OF THE INVENTION

The multilayer heating textile article the invention exhibits numerous advantageous characteristics and aspects, in part already before implicitly announced and later still further emphasized, so as to be adapted to be conveniently used with positive results in a wide range of applications and circumstances, as indicated in the following by way of example:

- uniformity and optimum distribution, over the entire surface of the textile article, of the heat generated by the heating layer, in particular thanks to the adoption, as electrical resistance for the generation of heat, of a textile yarn, exhibiting a straight configuration or serpentine or any other design, integrated in the fabric that forms the heating layer, as well as thanks to the choice of appropriate materials, in order to realize the various layers of the textile article, that allow to evenly distribute on the entire surface of the article the heat produced by the yarn constituting the electrical resistance;
- heat conveying to one and determined side of the fabric, with a positive effects on the energy performance of the fabric and its ability to efficiently transmit heat to the outside, through the adoption of a reflective layer, of a material suitable to reflect heat, arranged adjacent to a side of the heating layer that generates heat;
- article ability to produce a supplementary warming effect, in addition to that generated by the proper heating layer incorporating the electrical resistance, through the emission of infrared rays emitted from a possible further layer, heated, of suitable material;
- possibility, thanks to the use of a special warp knitting loom or machine of the crochet type in the manufacture of the fabric constituting the electrified heating layer of the article, by inserting into the warp-weft base of the fabric a heating yarn or wire, to realize the design of the yarn or wire, constituting the electrical resistance integrated in the heating fabric, according to a wide range of shapes and designs, for example straight, serpentine, or other forms
- possibility, always thanks to the use of these special warp knitting looms of the crochet type, to realize an electrified fabric and therefore an article which extends in three dimensions so as to be capable of adapting to the spatial and three-dimensional shape of the object and/or the material to be heated;

reduced thickness of the multilayer textile article as a whole;

reduced electrical consumption also thanks to the capacity of the textile article to make uniform and distribute the heat that is generated on the whole surface of the same article;

use of the article of the invention for the heating of floors;

use of the multilayer textile article as heating element in heating radiators, electric kettles and heating tanks;

application of the article as heating sheet inserted and integrated into a carpet;

industrial heating of machinery and equipments;

heating of greenhouses and in general in agriculture and cultivation of plants;

heating in the field of zootechny;

use of the article as heating sheet and fabric in clothing and in the field of household items such as curtains and others;

heating of seats and armchairs of motor vehicles;

heating of slabs, containers, and in general of fiberglass structures;

heating with infrared emission in veterinary and agriculture;

heating with emission of infrared rays in the medical field;

heating with infrared ray emission in the industrial field.

BRIEF DESCRIPTION OF THE DRAWINGS

These and other objects, features and advantages of the present invention will clearly appear from the following description of a preferred embodiment thereof, given solely by way of a non-limiting example with reference to the accompanying drawings, wherein.

DESCRIPTION OF SOME PREFERRED EMBODIMENTS OF THE HEATING MULTILAYER TEXTILE ARTICLE OF THE INVENTION

With reference to the drawings, a heating fabric or in general a heating textile article, in the form of a multilayer sheet, according to the present invention, is indicated in the whole with 10.

Without prejudice to the technical concept which is at the basis of the invention, the heating multilayer textile article 10 can be realized and implemented according to a wide variety of embodiments, and be applied and used in a corresponding wide variety of circumstances and forms of application.

So, in order to allow a complete understanding of the invention, there will be described in the following the characteristics and the various specific details of some, preferred, of these embodiments and applications of the heating multilayer textile article 10 of the invention.

In this regard it is remarked that, in the following description, the reference to a given embodiment does not exclude that a particular configuration, structure or characteristic described in relation to this given embodiment can also be included in other embodiments, in which for reasons of brevity it has not been described.

It also follows that particular configurations, structures or characteristics may be combined in any suitable manner in one or more embodiments.

Furthermore, the references used here only respond to needs of opportunity and therefore do not define or limit in any way the extension of protection and the scope of the embodiments described in the following.

First Embodiment

Figure 1A:
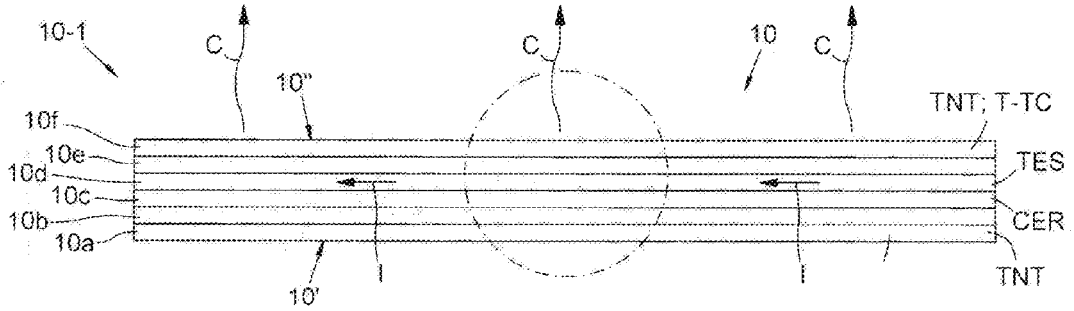
FIG. 1A is a schematic view, in section, of a textile article, in the form of a multilayer heating sheet or fabric, according to the present invention, in a first embodiment.
Figure 1B:
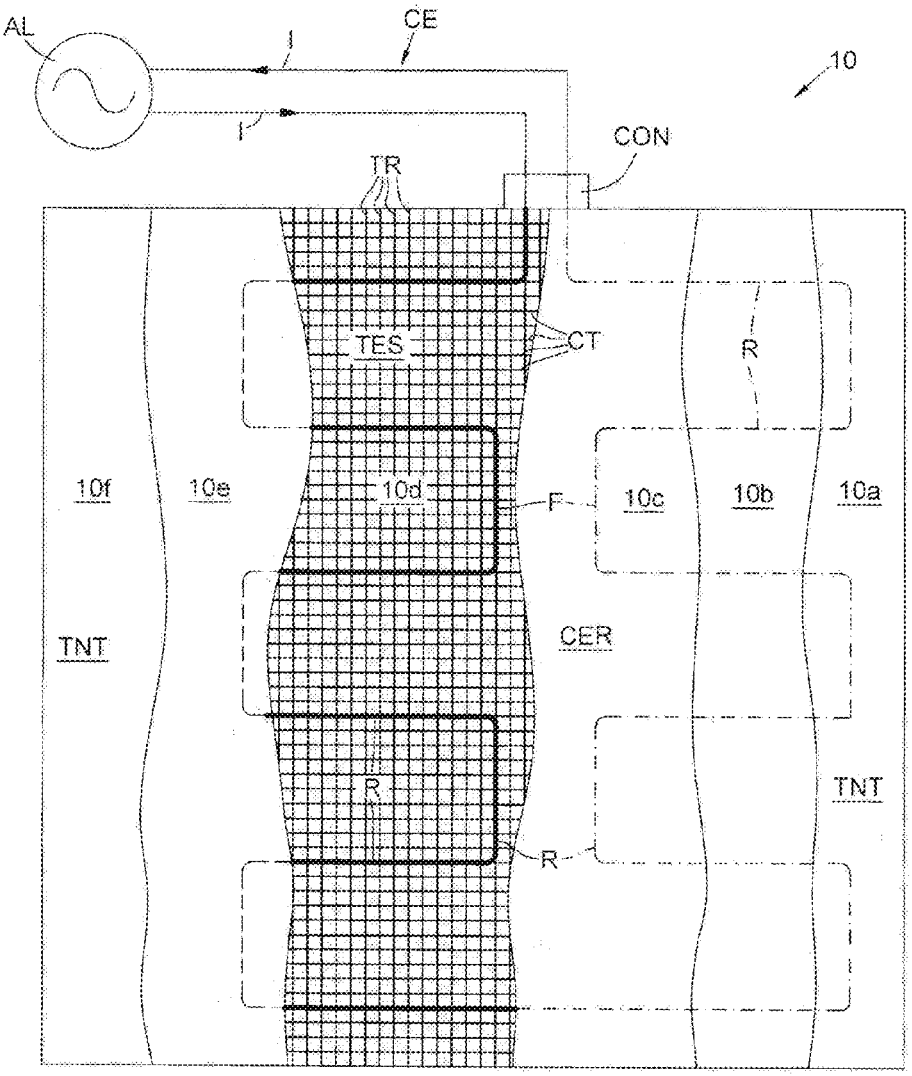
FIG. 1B is a schematic view, in plan, with the layers partially removed, of the heating textile article of FIG. 1A, in the respective first embodiment.

In detail, with reference to the schematic views of FIGS. 1A and 1B, the heating multilayer textile article 10, in a respective first embodiment indicated with 10-1, includes:

- a first outer support layer 10*a*, also called rear support layer, usually of textile material, arranged on a lower or rear side 10' of the textile article 10-1;
- a second insulating layer 10*b*, inner, made of a thermally and electrically insulating material, superimposed on the first support layer 10*a* on the opposite side to the rear side 10' of the textile article 10-1;
- a third reflective layer 10*c*, inner, made of a heat-reflective material, superimposed on the second layer 10*b* on the opposite side with respect to the first layer 10*a;*
- a fourth heating layer 10*d*, interior, superimposed on the third layer 10*c* on the opposite side to the second layer 10*b*, wherein this fourth heating layer 10*d* incorporates an electrical resistance adapted to generate heat and thereby to heat the textile article 10-1;
- a fifth insulating layer 10*e*, inner, made of a thermally and electrically insulating material, superimposed on the fourth layer 10*d* on the side opposite to the third layer 10*c*; and
- a sixth outer transmitting layer 10*f*, also called front support layer, suitable for transmitting the heat to the outside, superimposed on the fifth layer 10*e* and arranged on a front side or front 10" of the textile article 10-1.

First Support Layer

Passing to describe in detail the above-mentioned various layers of the textile article 10-1, the first support layer 10*a*, arranged on the rear side 10', operates essentially as a support of the textile article 10-1, and can for example be constituted by a nonwoven fabric, indicated with the acronym TNT (from the Italian "Tessuto-Non-Tessuto", made of 100% of polyester, or even by a usual fabric of polyester, having a typical warp-weft base structure.

It is noted that this support layer 10*a* may not be present and necessary in other embodiments of the textile article 10 and related applications, as hereinafter more fully described, such as, for example, in the application of the textile article 10 as inner lining for heated jackets.

Where the textile article 10-1 is expected to reach high temperatures, this first support layer 10*a* can also be realized instead of polyester fibers with other types of fibers, such as glass fibers or aramid fibers.

Second Insulating Layer

The second layer 10*b*, made of a thermally and electrically insulating material, in turn operates, in the article 10-1, as insulation element against moisture coming from the outside, while providing in the same time the necessary electrical insulation, towards the outside, of the current that passes through the fourth electrified layer 10*d* of the textile article 10-1 to generate heat.

This second insulating layer 10*b* is normally constituted by a layer of polyurethane which is applied on the material of the support layer or sheet 10*a*, when the heating article 10-1 is provided for operating at relatively low temperatures, or it can be made of a fabric of glass or aramid fibers, when the heating article 10-1 is provided for operating at medium or relatively high temperatures.

Third Reflective Layer

The third layer 10*c* constitutes a distinguishing feature of the textile article 10-1 and is the layer that has the specific function of limiting the propagation of heat downwards, i.e. towards the back or rear side 10' of the article 10-1, by reflecting the heat generated by the heating layer 10*d* toward the top or upper side 10" of the article 10-1.

Therefore, the third layer 10*c* causes that the heat produced by heating the inner layer 10*d* is effectively conveyed towards a given and determined side of the article 10-1, i.e. the upper side 10", with positive effects on the thermal efficiency and performance of the same article 10-1, as also further described later.

Furthermore, the third reflective layer 10*c*, as further effect, makes uniform the heat on the whole area of the article.

This reflective layer 10*c* preferably, but not necessarily, contains a ceramic material CER and for example it can be made up of a membrane of such ceramic material CER.

Fourth Heating Layer

The fourth layer 10*d* constitutes the proper heating layer and in particular is made from a fabric TES that incorporates in its basic textile structure consisting of warp and weft yarns, respectively indicated with TR and CT, an electrical resistance R, which is suitable to be powered and fed with an electric current I through a power supply AL, as shown schematically in FIG. 1B, for example constituted by the usual mains power supply, so as to warm up and generate heat by joule effect, when the resistance is fed by the current I, thereby heating also the textile article 10-1 in its whole.

In particular, the electrical resistance R is in the form of a yarn or thread or wire or cord F which is integrated in the weft and warp yarn structure of the fabric TES so as to exhibit a given design, for instance a serpentine design like that shown in the drawings, or a zig-zag design or similar.

The warp and weft base structure of the fabric TES can be constituted by cotton, polyester, fiberglass or aramid yarns according to the type of application to which the article is intended.

Therefore the structure of weft and warp yarns of the fabric TES has both the function of providing support to the yarn, and to the respective design, constituting the electrical resistance R, and of evenly distributing the heat generated by heating the electrical resistance R on the whole area of the article 10-1.

Advantageously, according to a characteristic capable of distinguish in a clear and inventive way the multilayer article 10 of the invention from those currently known and previously illustrated, the fabric TES that integrates in its base of warp and weft yarns the yarn F that constitutes the electrical resistance R is a fabric of the so-called "crochet" type, this meaning that is realized by means of special looms or textile machines for warp knitting called precisely "crochet" machines, since they use a hook, in French "crochet", to insert the yarns and form the fabric.

Therefore this warp knitted fabric of the "crochet" type, by which it is realized the heating layer 10*d*, exhibits unique characteristics and is substantially different from other types of fabrics made with other types of textile weaving looms.

Preferably the thread or yarn F, which constitutes the resistance R integrated in the base of weft and warp of the fabric TES, is in turn made up of carbon filaments FC, but it may be made from any other material that has characteristics, from an electrical point of view, similar to carbon.

In particular, in the manufacture of the fabric TES, through the crochet machine, the yarn F of carbon fibers is used as yarn effect to realize and incorporate into the fabric TES the electrical resistance R in such a way that it exhibits a particular design or shape, for example, as already said, a serpentine or a zig-zag design.

In this way, advantageously, the cost of implementation and integration of the electrical resistance R into the fabric TES and therefore also the final cost of the electrified fabric TES are particularly low, since the integration and the formation of such electrical resistance is realized simultaneously with the manufacture of the fabric, whereas in the prior art, often, the electric resistance is applied and integrated into the fabric in a separate step from the manufacture of the same fabric.

Moreover, as a further advantage, a warp knitting machine or loom of the "crochet" type allows le insertion into the fabric, in order to realize the electrical resistance R, of usual yarns, in particular consisting of carbon fibers, thereby avoiding to have to insert into the fabric filiform resistances provided with an outer sheath, implying an additional cost, as happens in the known art.

Figure 1C:
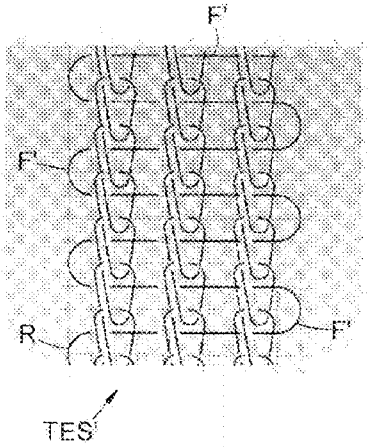
FIG. 1C shows a first configuration of the warp and weft structure of a fabric which is made using a special warp knitting machine o loom of the "crochet" type, with this fabric constituting an intermediate heating layer of the multilayer textile article of the invention of FIGS. 1A and 1B.

For a complete information, FIG. 1C shows more in detail a possible configuration and example of the warp and weft yarn base, simply schematized with a mesh in FIG. 1B, concerning a fabric TES', manufactured with a "crochet" machine, i.e. with a machine of the same type of that used to make the heating layer 10*d*.

As can be seen from FIG. 1C, the base structure of the fabric TES' exhibits a yarn or thread F', constituted precisely by the carbon yarn which realizes the electrical resistance R, wherein, during manufacture of the fabric TES' with the "crochet" machine, this carbon yarn F' is appropriately controlled so as to follow, in the fabric in formation, a given path, in turn corresponding to the design of the electrical filiform resistance R to be integrated into the fabric TES'.

Figure 5:
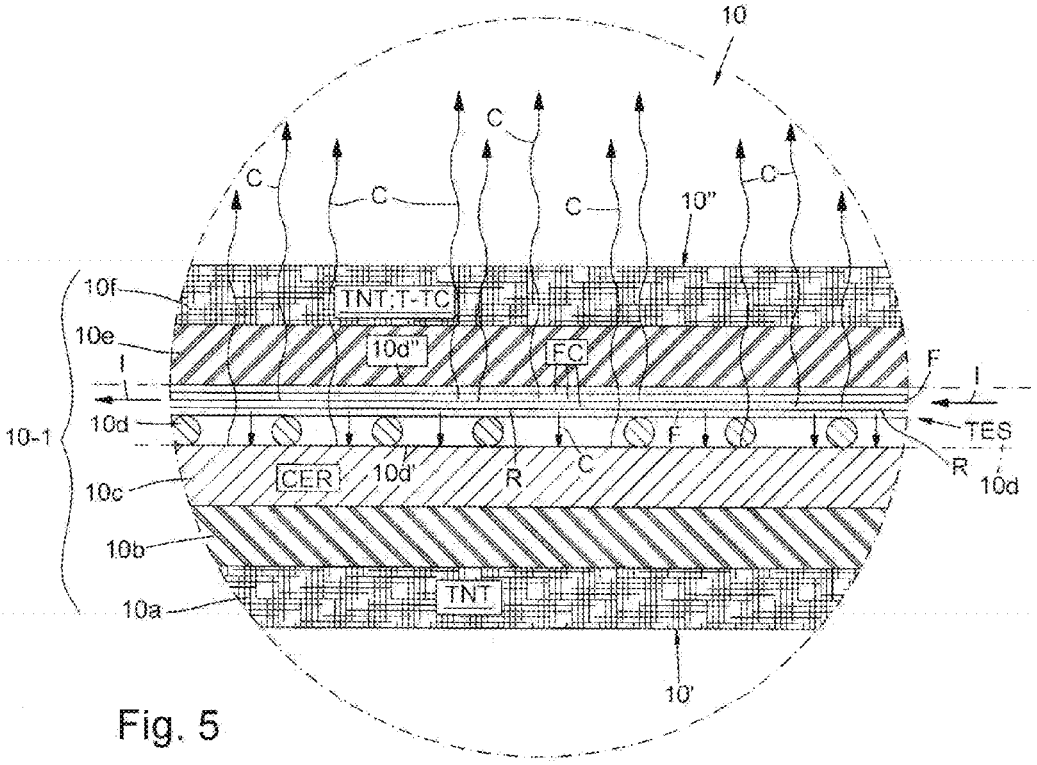
FIG. 5 is an operational scheme, corresponding to the area indicated by a dot-dash circle in FIG. 1, which illustrates the operation of the heating multilayer textile article of the invention.

For greater clarity, FIG. 5 shows that, in the heating layer 10*d*, the carbon yarn F, constituting the electrical resistance R integrated into the fabric TES manufactured with a crochet type loom or machine, is configured to run and pass over the threads of the warp and weft base textile structure, for example of polyester yarns, of such fabric TES, in order to realize the specific design of the electrical resistance R.

Figure 1D:
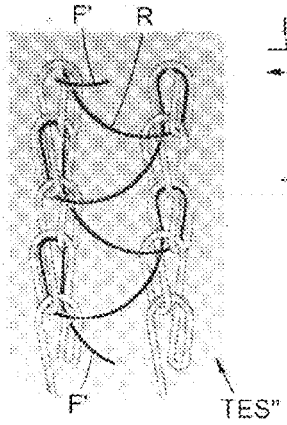
FIG. 1D shows a second configuration of the warp and weft yarn structure of a fabric which is made using a special warp knitting machine or loom of the crochet type, with this fabric constituting an intermediate heating layer of the multilayer textile article of the invention of FIGS. 1A and 1B.

Furthermore, FIG. 1D shows in detail a further possible configuration and example of the base structure of warp and weft threads of a fabric TES", manufactured with a warp knitting machine of the crochet type, like that used to realize the heating layer 10*d*.

Even here, FIG. 1D clearly shows that the fabric TES" integrates a thread or yarn F', justly constituted by the carbon yarn which realizes the electrical resistance R, which carbon yarn, during manufacture of the fabric TES' by means of the warp knitting machine, is appropriately controlled so as to follow, in the fabric in formation, a given path and interlacing with the other yarns, in turn corresponding to the design of the filiform electrical resistance R to be integrated into the fabric TES".

According to a further characteristic capable of qualifying and distinguishing significantly the article 10 of the present invention in comparison to the known articles, as also further described in the following, the heating yarn F inserted into the fabric TES is adapted to be connected and powered directly from the mains, without requesting the provision of electrodes or conductive bands that extend laterally along one edge or opposite edges of the fabric, as it often occurs in the known articles.

Figure 1E:
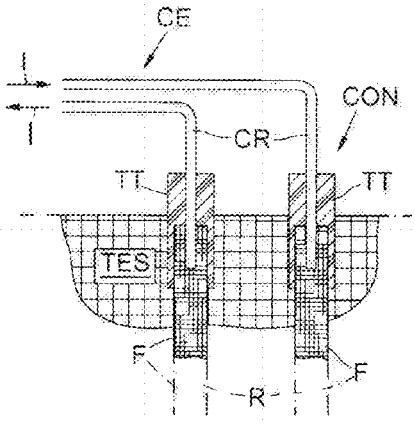
FIG. 1E is a schematic view of the connection zone between a heating yarn or wire of carbon, inserted into the textile structure of the intermediate heating layer of the article of the invention, and an electric cable connected to the mains power supply.

For clarity FIG. 1E shows schematically this direct connection, indicated in its whole with CON, between the heating yarn F, consisting of carbon filaments and fibers, and the mains power supply AL, wherein the energy or electric current I is fed directly to the heating carbon yarn F by means of a pair of conductive wires CR, in turn defining an electrical cable CE connectable to the mains power supply AL, which are inserted inside the carbon filaments of the two ends of the heating yarn F and are individually sealed by means of a heat-shrinkable tube or sheath TT, so as to lock and fix stably each wire CR, and therefore the electrical cable CE, to the thread F of carbon.

It is also emphasized that the fabric TES, made with the crochet warp knitting machine and incorporating the electrical resistance R, has the significant advantage of being suitable to be formed in the three dimensions, so as to be able to take, if necessary, a three-dimensional shape corresponding exactly to that of the object or surface with which the heating textile article 10 will be coupled in the use.

Figure 6A:
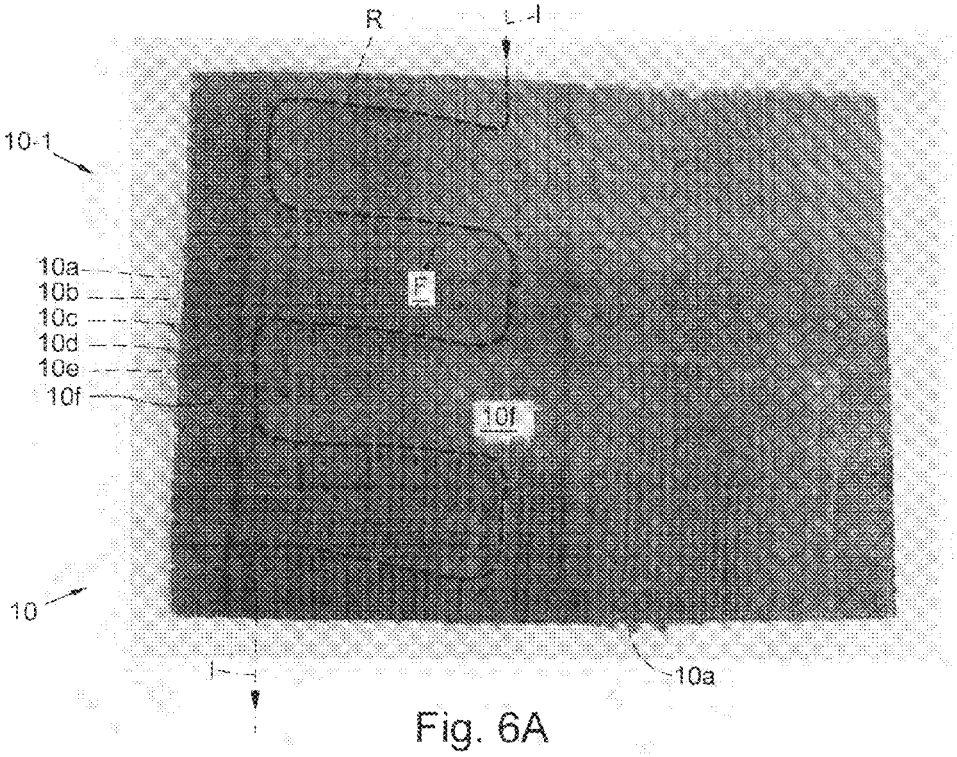
FIG. 6A is a photographic view of a sample of the first embodiment, shown in FIGS. 1A and 1B, of the heating multilayer textile article according to the present invention.
Figure 6B:
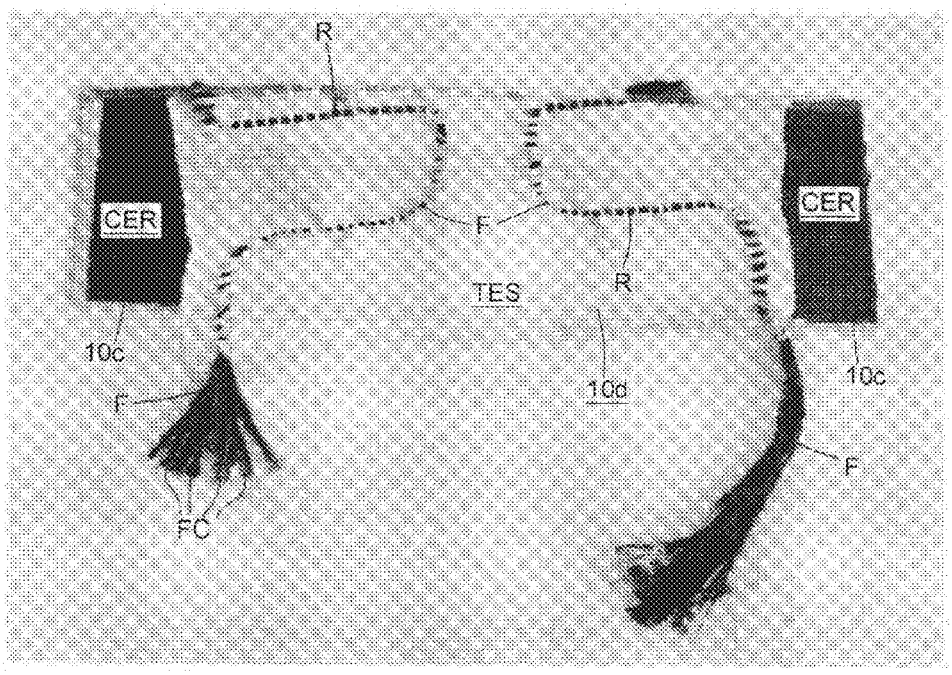
FIG. 6B is a photographic view of a heating layer and a reflective layer of the sample of FIG. 6A of heating multilayer textile article according to the present invention.

Even the photographic image of FIG. 6B shows, while integrating FIGS. 1A and 1B, an effective sample of the heating layer 10*d* made by a crochet machine and incorporating the electrical resistance R constituted by the yarn F of carbon.

Reference is also made to the previous presentation of the prior art in the introductory part of this description, including the specific documents referred to in such presentation, in order to illustrate and further emphasize the significant differences and advantages of this fourth heating layer, made as said with a warp knitting machine of the "crochet" type, and therefore also of the article which incorporates this layer, compared to the embodiments and the heating articles currently known and available in the market.

Fifth Insulating Layer

The fifth layer 10*e* is substantially equal to the second layer 10*b*, i.e. is constituted by the same materials, and similarly to the second layer 10*b* acts as an insulator against moisture coming from the outside, while providing the necessary electrical isolation for the current I flowing in the electrical resistance R integrated in the fabric TES of the heating layer 10*d*.

Therefore this fifth insulating layer 10*e* is normally constituted by polyurethane foam, where the article heater 10-1 is provided for operating at relatively low temperatures, or it can be made from materials such as silicone or aramid fibers, where the heating article 10-1 is provided for operating at medium or relatively high temperatures.

The fifth layer 10*e*, in addition to be able to act as an insulator, also produces a further effect directed to make uniform the heat, since it allows to distribute the heat produced by the electrified fabric TES on the whole area of the textile article 10-1.

Sixth Transmitting Layer

The sixth outer layer 10*f*, arranged on the front side or front 10" of the textile article 10-1, has in turn the function of making uniform the heat over the entire area of the textile article 10-1, allowing the transfer of heat to the outside of the article itself.

Usually, and typically in standard applications, the material constituting this sixth outer layer 10*f* is the same as that constituting the first support layer 10*a*.

Therefore, the sixth layer 10*f* can for example be constituted by a nonwoven fabric TNT, or by a usual fabric, indicated with T-TC, having a textile base of warp and weft threads of polyester or other fibers.

Furthermore, similarly to the first support layer 10*a*, in certain applications this sixth layer 10*f* may also not be present, especially if it is necessary to reduce the weight and thickness of the textile article 10.

Figure 1F:
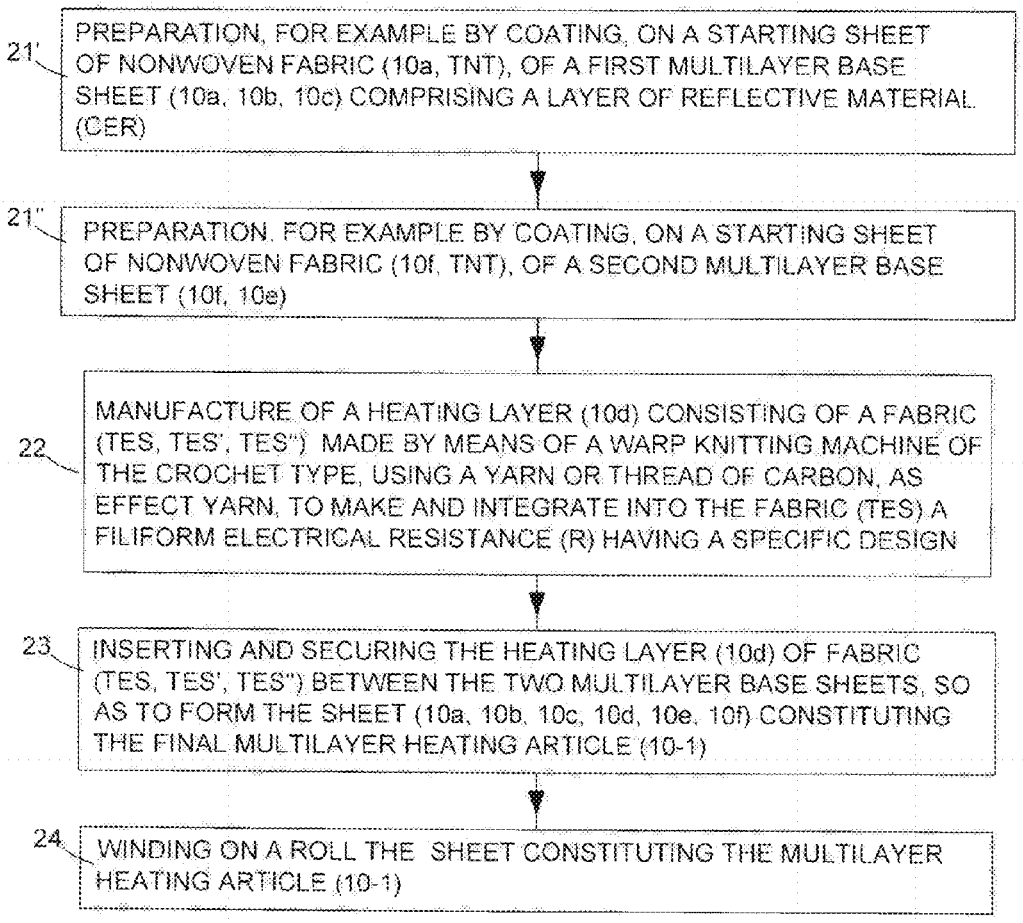
FIG. 1F is a flow diagram which schematically illustrates the manufacturing process of the multilayer heating textile article of the invention of FIGS. 1A and 1B.

To complement the description of the multilayer structure of the textile article 10-1, the flow chart of FIG. 1F schematically illustrates the manufacturing process of the same article 10-1.

In detail, such manufacturing process comprises a series of preliminary steps for preparing the sheets intended to be joined together so as to form the final multilayer textile article 10-1.

More precisely, in a first preliminary phase indicated in the whole with a block 21' in FIG. 1F, a first multilayer base sheet is made from a sheet of nonwoven fabric, intended to constitute the outer lower support layer 10*a* in the final article 10-1, applying on a side of such sheet of nonwoven fabric, for example by spreading, a thickness of insulating material so as to form the layer intended to constitute the insulating layer 10*b*, and then applying on the thickness of insulating material a thickness of ceramic material in order to form the layer which will constitute the reflective layer 10*c* in the final article 10-1.

Similarly, in a second preliminary phase indicated in the whole with a block 21", a second multilayer sheet is made from a sheet of nonwoven fabric, intended to constitute the outer upper support layer 10*f* in the final article 10-1, applying on a side of said sheet of non-woven fabric, for example by spreading, a thickness of insulating material so as to form the layer intended to constitute the insulating layer 10*e*.

Furthermore the fabric TES, intended to constitute the intermediate heating layer 10*d*, is woven separately, in a further preliminary phase indicated with a block 22, through a crochet type warp knitting machine, using, as before said, the carbon yarn F, as effect yarn, to implement and integrate into the fabric TES the filiform electric resistance R.

Then, as indicated by a block 23, in FIG. 1F, the fabric TES is inserted and fixed between the two base sheets previously prepared, so as to form the final multilayer textile article 10-1.

Finally, as indicated by a block 24, the final article 10-1 is wrapped on a roll.

Second Embodiment

Figure 2:
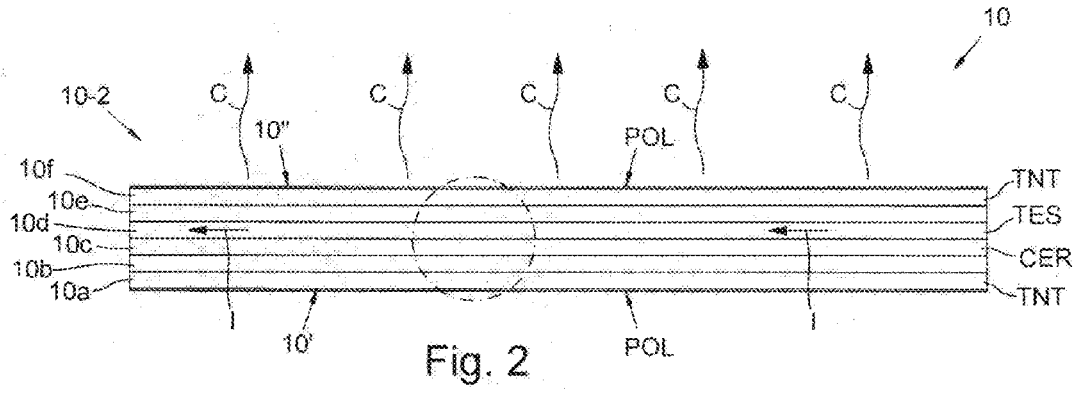
FIG. 2 is a schematic and partial view, in section, of a heating multilayer textile article according to the present invention, in a respective second embodiment.
Figure 2A:
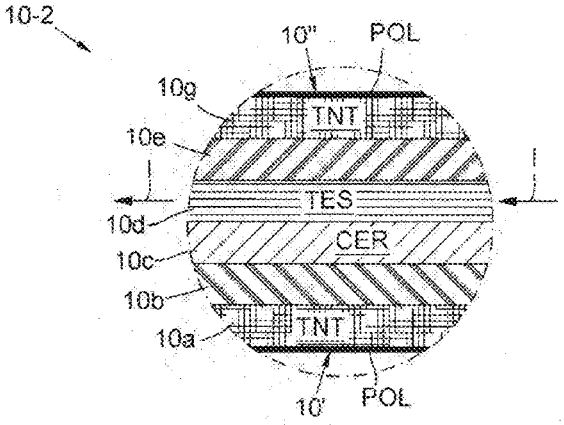
FIG. 2A is a view, in enlarged scale, of the area indicated by a dash-dot circle in FIG. 2.

FIG. 2 shows schematically a second embodiment indicated with 10-2 of the hearting multilayer textile article 10 of the invention.

This second embodiment 10-2, in which the parts corresponding to those of the first embodiment 10-1 are indicated as far as possible with the same references, always includes six superimposed layers, but differs from the first embodiment 10-1 because the two outer layers 10*a* and 10*f* of nonwoven fabric TNT are each covered with a thin layer of polyester, transparent, indicated with POL.

For example these two thin layers of polyester POL can be formed on the two opposite faces 10' and 10" of the article 10-2 with a coating operation or equivalent processes.

Figure 2B:
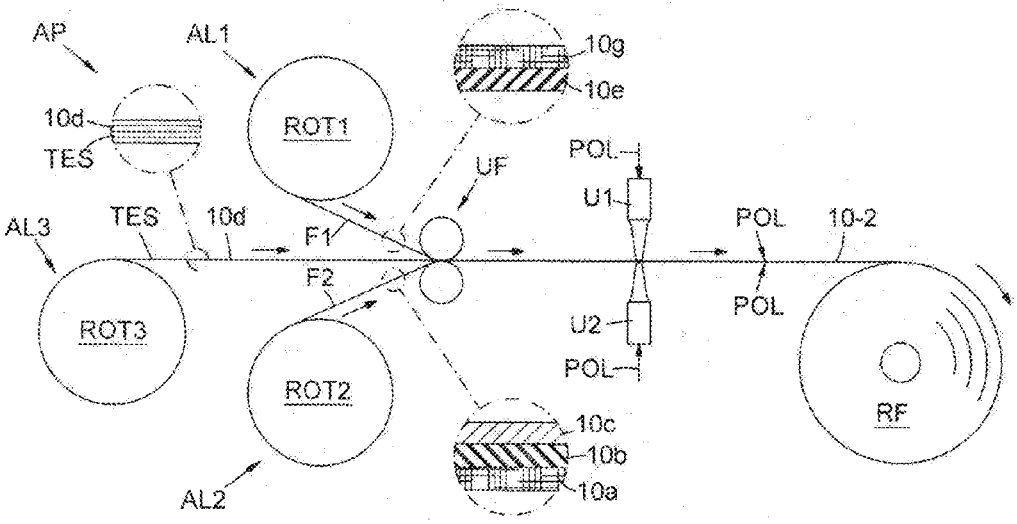
FIG. 2B is a generic scheme of an apparatus for the manufacture of the multilayer heating textile article or fabric of the invention of FIG. 2 and for its winding, as final product, in the form of roll.

For clarity and a more complete information, the diagram in FIG. 2B shows a possible apparatus or equipment indicated with AP to make the textile article 10 in accordance with this second embodiment 10-2.

In particular the equipment AP includes two power supply units AL1 and AL2 which are adapted to feed from two respective rolls ROT1 and ROT2, as also indicated by arrows, two starting sheets F1 and F2 consisting of a series of layers intended to be incorporated in the final article 10-2, and a third power supply unit AL3 for feeding from a respective roll ROT3 the fabric constituting the intermediate heating layer 10*d*.

Furthermore the apparatus includes a fixing unit UF, where the sheets coming from the three supply units AL1, AL2 and AL3 are joined and fixed, with the sheet fed from the feed unit AL3 being inserted between the sheets coming from the power supply units AL1 and AL2, so as to form the article 10-2, and two coating units, indicated with U1 and U2, having the function of spreading the polyester POL on the two opposite faces of the article 10-2 coming from the fixing unit UF and therefore form on it the thin outer layers of polyester POL, before the article 10-2 is wound on a final roll RF.

The two polyester films POL formed on the external sides of the article 10-2 allow both a better electrical insulation and to pass the tests and the testing of electrical safety which are provided by the regulations for this type of heating products.

Moreover, the two layers POL also serve as mechanical protection of the article 10-2, and prevent blunt instruments can damage its outer surface and the respective inner layers.

Third Embodiment

Figure 3:
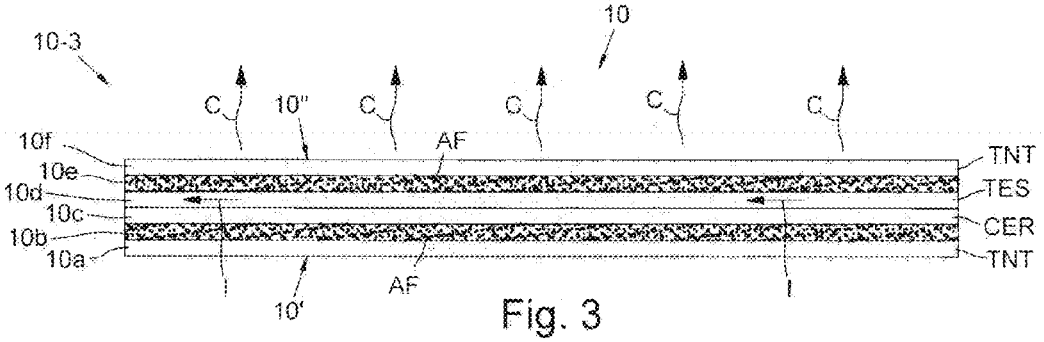
FIG. 3 is a schematic and partial view, in section, of a heating multilayer textile article according to the present invention, in a respective third embodiment.

FIG. 3 shows schematically a third embodiment indicated with 10-3 of the heating multilayer textile article 10 of the invention.

This third embodiment 10-3, wherein also here the parts corresponding to those of the first embodiment 10-1 are indicated as far as possible with the same references, always includes six superimposed layers, but differs from the first embodiment 10-1 in that the material, electrically insulating, which constitutes the two intermediate insulating layers 10*b* and 10*e*, also exhibits anti-flame properties, or contains one or more substances AF, for example phosphorus-based, which have the effect of block or delay the spread out of flame in the multilayer textile 10-2.

Thus, advantageously, in this third embodiment 10-3 the textile article 10 is able to block or delay the spread of flame inside the same article, thereby limiting the resultant damages, both when the heat comes from the outside, both when it is generated by overheating of the heating inner layer 10*d*.

Fourth Embodiment

Figure 4:
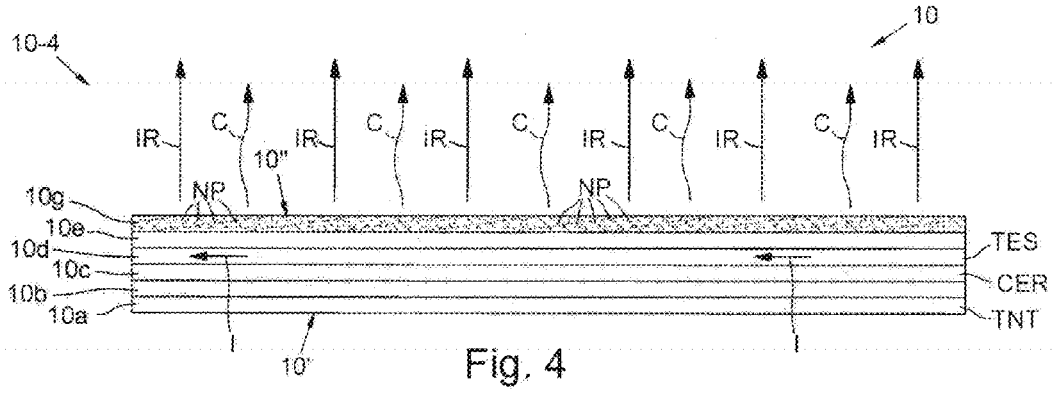
FIG. 4 is schematic and partial view, in section, of a heating multilayer textile article according to the present invention, in a respective fourth embodiment.

FIG. 4 shows schematically and in section a fourth embodiment indicated with 10-4 of the heating multilayer textile article 10 of the invention.

This fourth embodiment of 10-4, in which as already for the other ones the parts corresponding to those of the first embodiment 10-1 are indicated as far as possible with the same references, always includes six superimposed layers, but differs from such first embodiment 10-1 in that the upper outer layer, indicated with 10*g* and defining the determined upper face 10" for the transmission of heat to the outside, instead of being constituted by a nonwoven fabric is made from a material adapted to emit, when heated by the heat generated by the inner heating layer 10*d*, a radiation in the infrared range, shown schematically with arrows in FIG. 4 and indicated with IR (from Infrared).

In particular this layer 10*g* may be formed from a traditional warp and weft fabric of polyester or cotton mixed with polyester, wherein the yarns forming this fabric integrate in their fibrous structure of nano particles NP which have precisely the property of emitting, once heated, infrared radiation IR.

In this way the outer layer 10*g* allows to increase significantly the amount of heat produced by the textile article 10, in addition to that produced by the underlying layer 10*d* formed by the electrified fabric TES, by creating an emission of infrared rays which can give specific effects in special heating applications realized through the textile article 10.

Use and Operation of the Textile Article of the Invention

In the use of the heating multilayer article 10 of the invention, in its various embodiments described above, the user connects the article 10 to the power supply of the electric current, schematically shown in FIG. 1B with a power supply AL, by means of the electrical cable CE, shown schematically in FIG. 1E, in turn directly connected to the two ends of the heating yarn wire F of carbon inserted in the intermediate heating layer 10*d* of the same article 10.

In this way, the electrical resistance R, formed by such heating carbon yarn F integrated in the fourth intermediate heating layer 10*d*, is fed by an electric current I, so as to generate by joule effect heat which is distributed over the entire surface of the textile article 10-1 to warm it.

More in detail, as shown schematically in FIG. 5 with the aid of arrows C, the heat, which is generated by joule effect by the electric resistance R, spreads and is transmitted from both sides of the heating layer 10*d*.

However, while the heat C emitted and coming from the upper side 10*d*" of the heating layer 10*d* is transmitted and spreads directly into the external environment through the top face 10" of the multilayer article 10, the heat C emitted and coming from the lower side 10*d*' of the heating layer 10*d* is received and then reflected, as indicated by arrows, by the reflective layer 10*c* of ceramic material CER towards the upper face 10" of the article 10.

Therefore, advantageously, it is avoided that the heat is dispersed and spread through the lower face 10' of the article 10, but the most of the heat C generated by the heating layer 10*d* is caused to spread and be transmitted towards the outside through a unique and determined side 10" of the multilayer article 10, with positive effects both on the performances, as thermal heating capacity, and on the energetic efficiency of such article 10.

In particular it has been observed, from numerous tests carried out on samples of the textile article, that the ceramic material CER, constituting the reflective layer 10*c*, in addition to operate as a dielectric to isolate the electric current I flowing in the electrical resistance R, is such as to produce an efficient barrier and reflection action, towards the front side 10" of the textile article 10, of the heat generated by the electric resistance R incorporated in the heating layer 10*d*.

It is therefore clear that the heating textile article 10, in the form of a multilayer sheet, in its various embodiments described above, fully reaches the objects to which it was intended, and in particular is adapted to transmit and transfer efficiently to the external heat that is generated when it is warmed up.

Furthermore, the heating multilayer textile article 10 of the present invention involves industrial costs of manufacture that are particularly reduced, especially as regards the realization of the respective inner heating layer, which, being manufactured by a warp knitting machine of the crochet type with simultaneous formation of the design of the electrical resistance, is particularly economical and not expensive and moreover allows wide possibilities for realizing the design of the electrical resistance, unlike from the heating layers that are included in the heating multilayer articles currently available in the market.

Advantageous Features and Uses the Article of the Invention as Compared to the Prior Art As completion and integration of the previous description, there will be further illustrated and underlined in the following some of the numerous characteristics and advantages that distinguish the heating multilayer textile article of the invention in comparison with the known technique, like in particular that already specifically mentioned and discussed previously, and make the same article adapted to be conveniently used in a wide range of applications:

- capacity of the multilayer article of the invention, thanks to the fact of including a heating layer consisting of a fabric made with a crochet type warp knitting machine, to go beyond the limits and overcome the drawbacks of the classic warp and weft weaving, made with shuttle looms or rapier or grip and air looms, and their fabrics, as for instance the warp and weft fabric manufactured with a traditional shuttle loom and described by the patent WO 2006/054853 A1, already discussed in the introductory part of the description of the invention;
- in fact the classic weaving carried out by a shuttle loom, being the warp and weft threads positioned the former horizontally and the latter vertically, allows, in the realization of a fabric including one or more wires adapted to heat up electrically, only three types of electrical power supply to the wires, namely:
  - with conductive selvedge wires arranged on two opposite sides of the fabric (however, this configuration can easily cause short circuits and also generates electromagnetic waves since the electrical current runs on parallel lines in the same direction);
  - with conductive selvedge wires arranged on only one side of the fabric, for instance like in the fabric described by the already mentioned patent WO 2006/054853 A1 (however this configuration, although reducing the problem of short circuits and eliminating the generation of electromagnetic waves, involves very high costs of production);
  - with an electrical power supply of the heating wire or wires, with such power being realized on an edge, obtained by cutting, of the fabric (however even this configuration has the disadvantage of producing electromagnetic waves of considerable intensity and is also of difficult and delicate realization due to the fact that in the fabric manufactured with a shuttle loom the heating wire or wires to be electrically powered must be very fine in order to avoid short circuits);
- instead the crochet warp knitting, on which it is based and by which the heating layer of the article of the invention is made, is much more versatile and goes beyond the limits of the traditional shuttle weaving, and in particular allows to realize textiles constructions and structures more complex and robust so as to produce better results than the traditional weaving with a shuttle loom, which is much more rigid;
- in particular, contrary to the above and limited configurations that are permitted by the prior art based on the classic weaving by a shuttle loom, in the heating layer, included in the article of the invention, the conductive wire of carbon, thanks to the fact that the fabric constituting the heating layer is based and made by a warp knitting loom of the crochet type, can run and extend in a continuous manner according to a configuration in parallel bands, thus solving both the problem of not generating electromagnetic waves and that of avoiding short circuits, since the electric current runs in the reverse direction in the two by two adjacent bands;
- in this respect it is again pointed out that, while in the fabric described by the patent WO 2006/054853 A1, the heating wire is fed electrically by means of so-called "electrode fibers" or electrodes that are made in the fabric with warp conductive fibers and wires, or through similar conductive elements or bands, as well as in other embodiments of the prior art, in the article of the present invention the power supply is applied to the heating yarn or wire directly from the mains;

in other words, the article of the invention does not present any "electrode fiber", since the special conformation of the crochet fabric by which the intermediate heating layer is made does not require this element or a similar conductive band, and the electricity is fed directly to the carbon yarn by means of a connection that is made with a copper cable that fits inside of the carbon filaments of the yarn and is then sealed by a heat-shrinkable tube which blocks the conjunction of the cable copper with the carbon wire;

in particular, this connection of the conductive yarn of carbon to the mains can be easily realized, since the carbon yarn is big enough to receive the insertion of the copper cable;

also, advantageously, in the heating layer article of the invention, characterized by a textile structure made by a crochet knitting machine, the carbon yarn or wire is never in a position suitable to create a short circuit, as it may happen in the known technique, for example in the fabric described by the patent WO 2006/054853 A1, since the distances between the portions of the carbon wire inserted in the fabric are such as to avoid this risk of short circuit and since the carbon wire does not pass through and never intersects conductive wires or bands, for the power supply, which run laterally along the edge of the fabric, such as the so-called "electrode fibers" present in the conventional heating fabric described by this patent WO 2006/054853 A1;

the costs of production of the article of the invention are significantly reduced, particularly because, as explained before, the heating fabric included in the article does not imply the inclusion of "electrode fibers" or the like, and even the inclusion of insulating elements to prevent short circuits, by contrast to the heating fabric described by patent WO 2006/054853 A1;

therefore, advantageously, the article of the invention is very versatile, i.e. it may be realized in a multiplicity of forms according to the uses, and in particular it is further remarked that it does not exhibit "electrode fibers" or similar conductive elements, to power the heating textile layer, which are instead present in the embodiments of the prior art and which must be suitably dimensioned so as to take account of the destination and end use of the article;

consequently the article of the invention does not has the problem of a complex construction, which instead affects the prior art, such as for example the heating fabric described by the patent WO 2006/054853 A1, in which fabric the heating wire is connected to "electrode fibers" in order to receive the power supply;

possibility of arranging in the article of the invention the heating wire or wires according to a wide variety of configurations, also different from the standard, for example having a zigzag shape or with intersections, when serving a specific provision of the heating wire to improve the supply of heat, thanks to the fact that the heating layer included in this article is made by a warp knitting machine of the crochet type, whereas this wide variety of configurations are not in any way obtainable by a traditional shuttle weaving, or rapier or grip or air weaving;

even when compared to the heating article described by the document WO00/19773 A1, already mentioned previously, the heating multilayer article of the invention exhibits relevant and advantageous differences, in that it does not present any power supply, based on conductive bands arranged on opposite sides of the heating fabric, which, as known, has the drawback of generating waves and electromagnetic effects since the electrical current runs on parallel lines in the same direction;

in addition, also with respect to the heating article described by document WO00/19773 A1, the article of the invention the heating differs advantageously in that it is made using the crochet warp knitting, i.e. a crochet warp knitting machine, where the heating article known from WO00/19773 A1 is instead made by means of conventional embroidery machines and lamination operations;

it follows that it is possible to realize the heating article of the invention with designs and configurations of the heating part that cannot be obtained in another way, in particular by the article, known from document WO00/19773 A1, realized, as said, by means of conventional embroidery machines and lamination operations;

also when compared to the band, described by document EP 0505936 A2 already mentioned earlier, to wrap and warm-up tires, the heating article of the invention appears to be a product that is completely different, exhibiting features and a structure completely different and not comparable with that of this band;

in particular, in the article of the invention the conductive heating wire or wires that electrically heat up are constituted by carbon fibers, preferably in free or untwisted form, while in the band known from EP 0505936 A2 the conductive wires are made of twisted metal steel wires so as to form a small rope;

in addition, also in the warm-up article known from EP 0505936 A2 the electrical power supply to the conductive wires is made by conductive side bands, similarly to the articles known from WO 2006/054853 A1 and WO00/19773 A1, while, in the heating article of the invention, the conductive heating carbon wire or yarn is directly powered by the electrical cable, connected at one end to the power supply and the other end directly to the same conductive wire, therefore without the interposition of electrodes or similar elements that are formed and extend along edges of the fabric.

Further Special Advantages of the Article of the Invention.

A further significant advantage, which deserves particular attention, of the multilayer article of the invention over the prior art, directly connected to the fact that the heating layer included in the article is constituted by a fabric obtained by warp knitting of the crochet type, consists in the possibility of using yarns with a reduced number of twists or even free of torsion, thereby having a lower cost, to weave and make the intermediate heating layer.

In fact, while in weaving with a traditional shuttle loom or grip or air loom and especially in embroidery there is the limit and the problem to be obliged to use a wire having a certain number of twists in order to enable the best and optimal use of the organs of the loom, for example the gripper, with these twists that become as a matter of fact indispensable to allow the use of the thread with the needle of the embroidery machine, in the weaning with a crochet machine and in general with a warp knitting machine this limit does not exist, whereby it is possible to use wires and yarns with a reduced number of twists or zero twists, thus having a lower cost than those usable on a grip and air loom.

Moreover, in the traditional weaving and embroidery, in which the insertion of the heating wire is carried out as described in the documents WO 2006/054853 A1 and WO00/19773 A1, the count of the wire or thread will necessarily be much less than that of the threads used in the crochet warp knitting, this meaning that the wire will be much finer, with all the effects, even negative, that the adoption of a wire having a fine count entails.

It follows that, with a traditional weaving or with a heating fabric produced in a traditional way by means of a shuttle loom or grip or air loom, there is the need of providing a number of meters of heating wire, and then a corresponding weight of the heating wire, very exceeding that necessary to obtain the same electric power and the same heating capacity with a fabric produced by means of a crochet machine.

The following example will illustrate better and clearly this important advantage of the multilayer textile article of the invention over the prior art.

It is supposed to compare the use, in order to manufacture a heating fabric, two heating wires with two different counts, such as 800 TEX and 3200 TEX, i.e. two counts, one of which is four times the other.

The wire or thread with count of TEX 800 has an electrical resistance of about 50 ohms per meter of yarn, while the wire with count of 3200 TEX has an electrical resistance of about 8 ohms per meter of wire.

This means that the electrical resistance is not proportional to the thickness or to the count of the wire, whereby applying a voltage of 230 volts to a meter of wire with 3200 TEX there is obtained a power of 6.6 KW, while applying a voltage of 230 Volt to a meter of wire with 800 TEX there is obtained a power of 1.06 KW.

Therefore in order to obtain, with the same wire having a count of TEX 800, the power of 6.6 kw, it is necessary to connect in parallel 6 meters of 800 TEX wire.

Now it is easy to calculate that the weight of meters of wire with TEX 800 is equivalent to 150% of 1 meter of wire with 3200 TEX.

It follows that, at parity of heat developed by the same surface of the fabric, the cost of the raw material, in the form of heating wire, to manufacture and to weave the heating fabric by using a traditional shuttle loom or the like, is higher by about 50% compared to the cost to manufacture the heating fabric by using a crochet warp knitting machine or loom.

Applications of the Heating Multilayer Textile Article of the Invention

In order to allow a better understanding of the innovative features and the relevant advantages of the heating multilayer textile article 10 of the invention, the following list illustrates, purely by way of exemplary and not exclusively example with reference to the graphical images of FIGS. 7A-7H, some of the numerous applications in which the textile article can be advantageously applied.

Figure 7A:
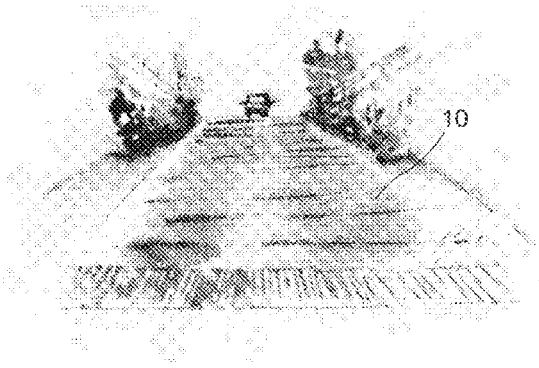
FIGS. 7A-7K are diagrams illustrating possible applications of the heating multilayer textile article according to the present invention.
Figure 7B:
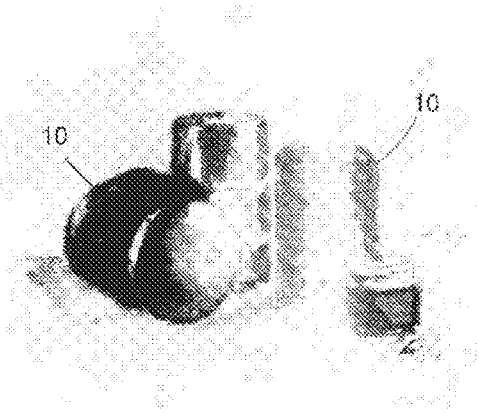
Figure 7C:
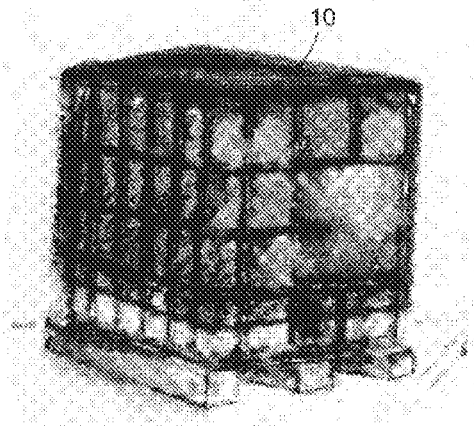
Figure 7D:
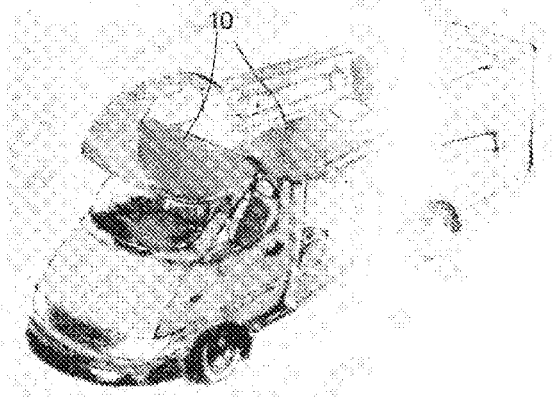
Figure 7E:
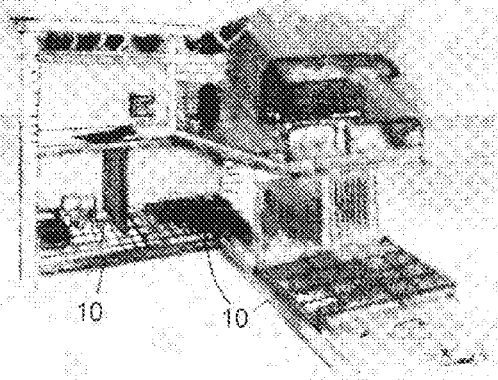
Figure 7F:
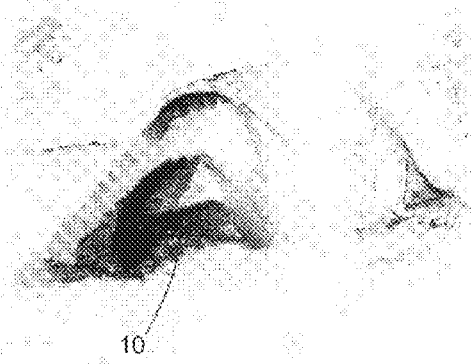
Figure 7G:
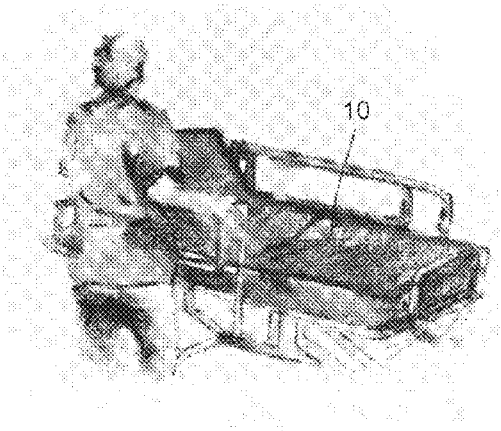
Figure 7H:
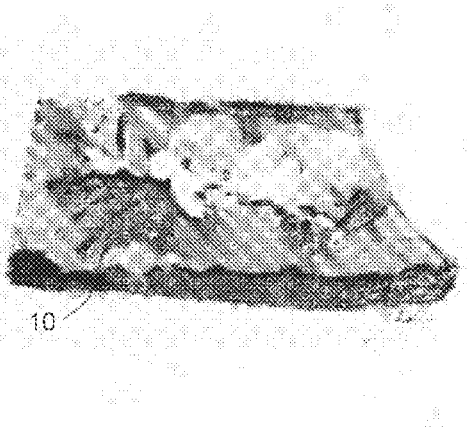
Figure 7I:
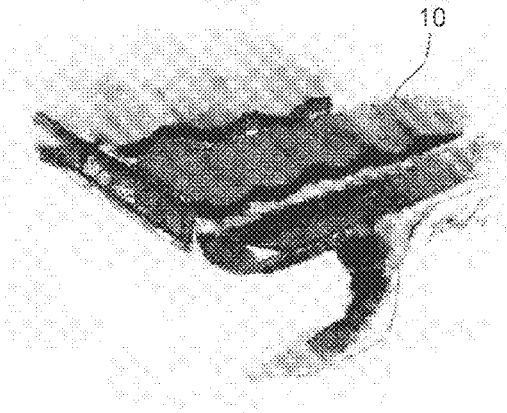
Figure 7J:
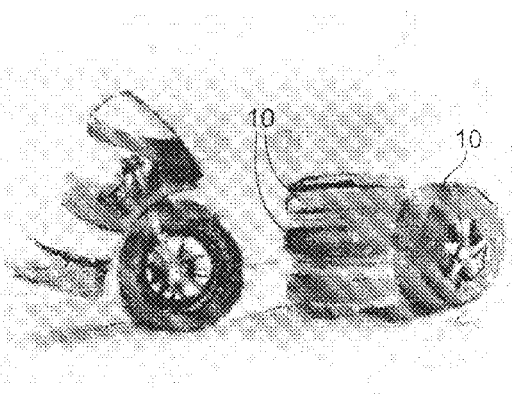
Figure 7K:
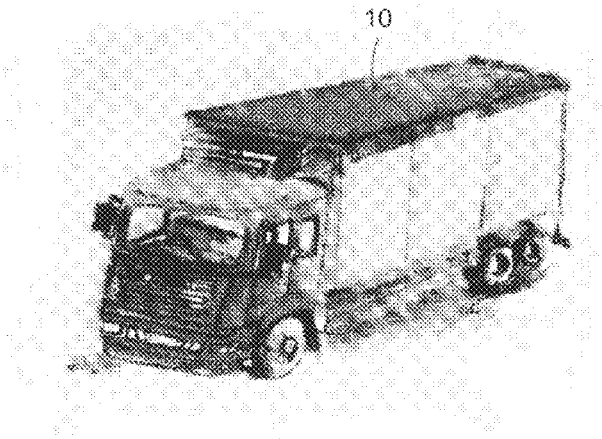

| Possible applications of the multilayer article 10 of the invention | Figure of the drawings |
|---|---|
| Anti-freeze coverage of road surfaces | FIG. 7A |
| Construction of floor heating | FIG. 7B |
| Coverage and protection of load units on pallets | FIG. 7C |
| Furniture components with heating capacity for the passenger compartment of motor vehicles | FIG. 7D |
| Thermal panels for habitations | FIG. 7E |
| Thermal curtains and tents | FIG. 7F |
| Beds for medical structures and/or hospital | FIG. 7G |
| Bedsteads for pets | FIG. 7H |
| Anti-ice covers for tiles | FIG. 7I |
| Covers with thermostat for tires | FIG. 7J |
| Thermal roofs for vehicles for transport of goods | FIG. 7K |

Furthermore, the photographic views of FIGS. 8A-8D show some of these applications, in their effective implementation, of the heating multilayer textile article according to the present invention.

Figure 8A:
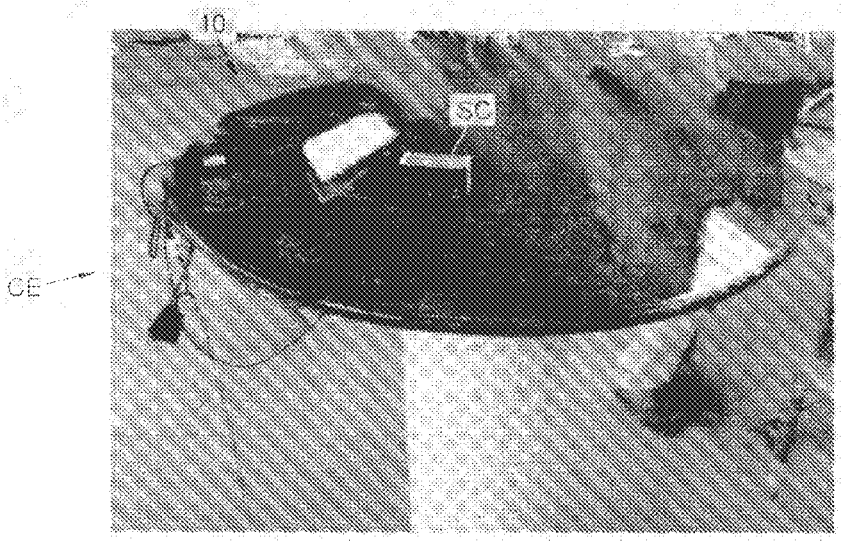
FIGS. 8A-8D are photographic views that show some actual applications of the heating multilayer textile article according to the present invention.
Figure 8B:
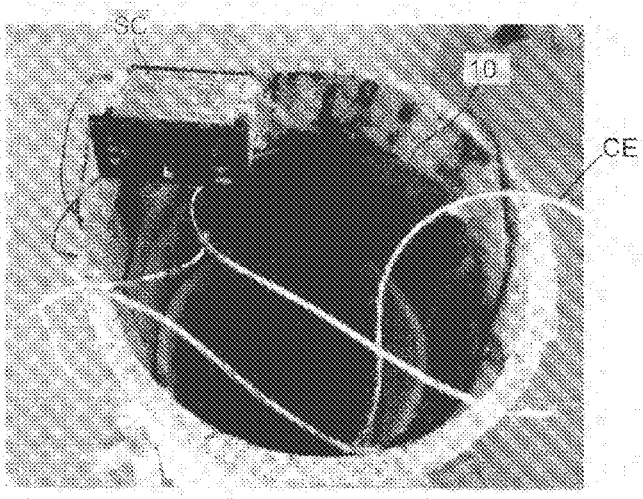
Figure 8C:
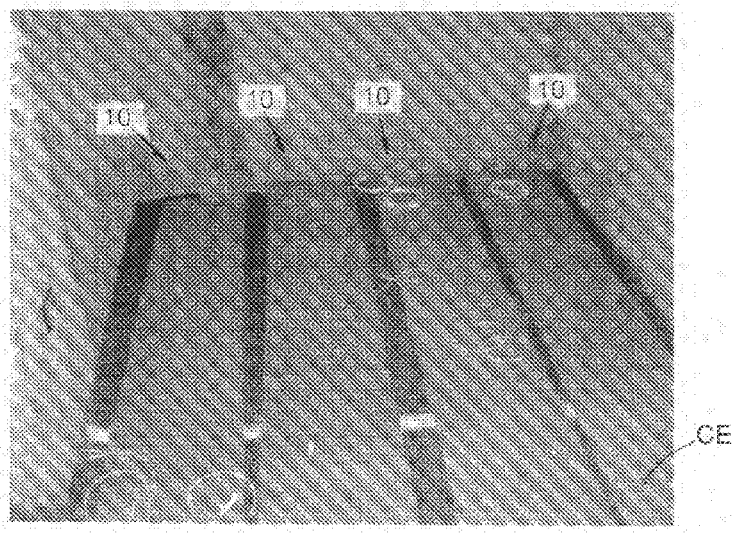
Figure 8D:
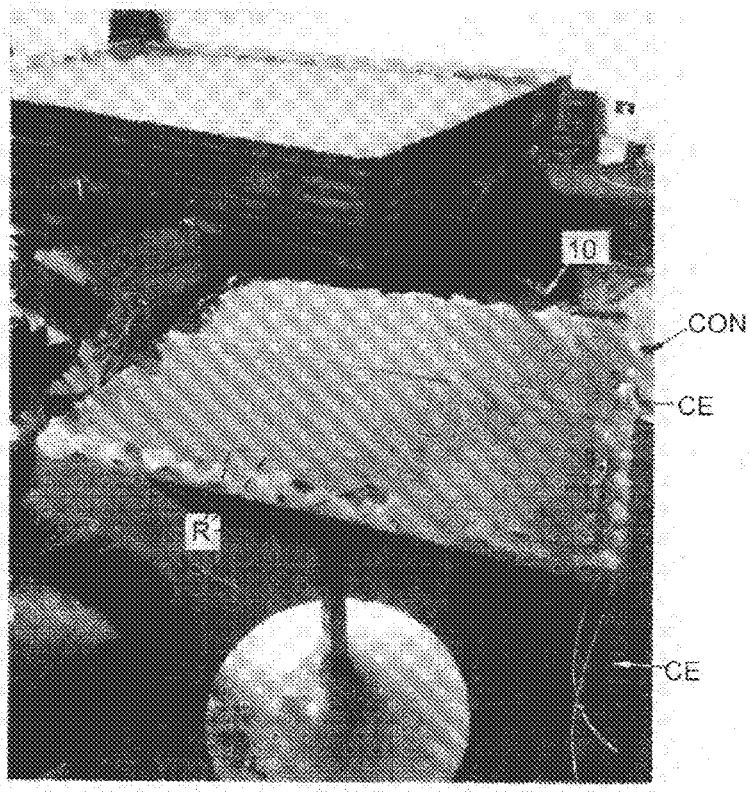
Figure 9:
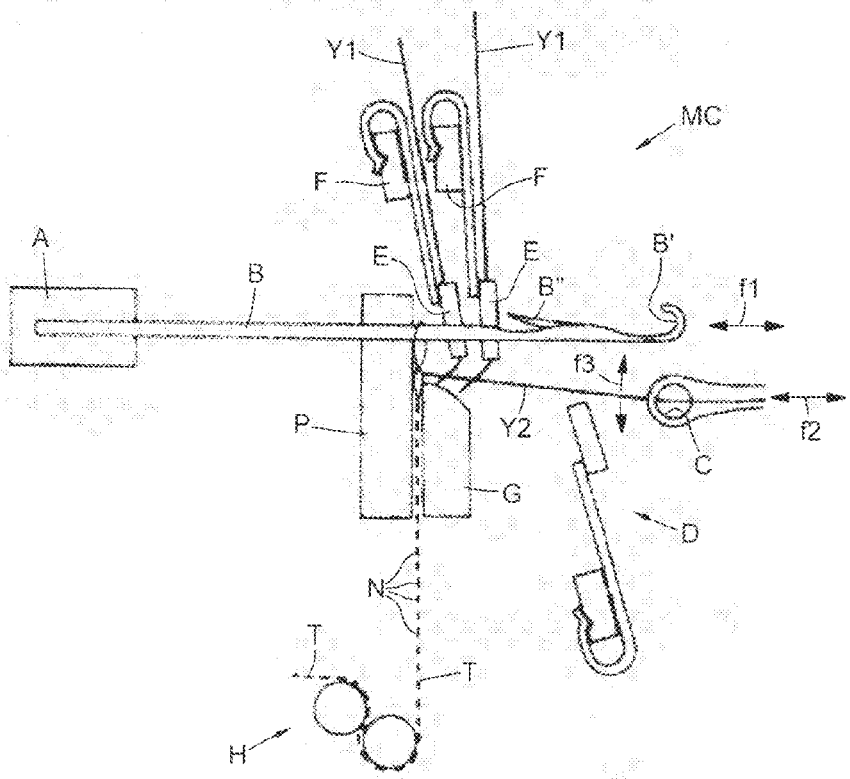
FIG. 9 is a diagram of a machine or loom for warp knitting, of the crochet type, used to make the heating layer or fabric included in the multilayer textile article of the invention.

In particular FIGS. 8A and 8B show the heating article 10 when it is used to prepare a heatable hollow structure, constituted for example by the base of a table, while FIG. 8C and FIG. 8D show the article 10 when it is used to realize respectively a hearable floor and a heatable table of a billiard.

It is remarked that in all these applications shown by the photographs of FIGS. 8A-8D the power cable CE, adapted to connect the article 10 to the external power supply, is in turn connected directly to the conductive wire that is integrated into the intermediate heating fabric included in the same article 10.

Figure 8E:
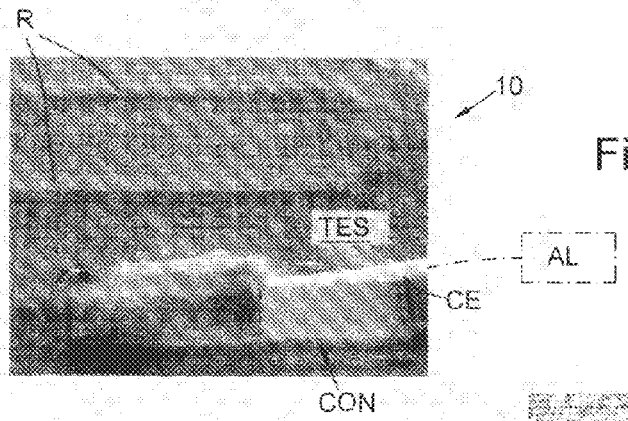
FIGS. 8E-8G are photographic views that show from near the area of connection between an electric power cable and the heating multilayer textile article according to the present invention.
Figure 8F:
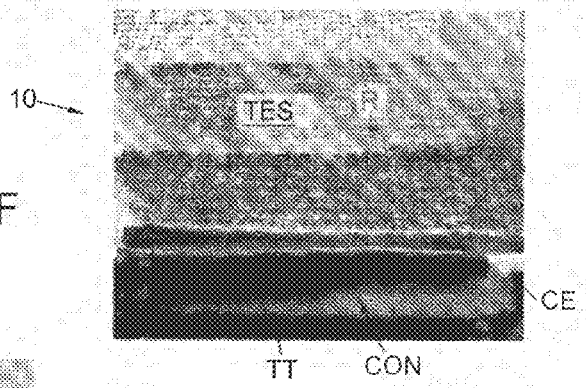
Figure 8G:
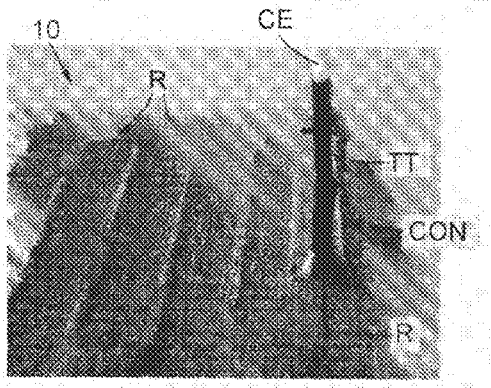

Still, for completeness, the photographic images of FIGS. 8E-8G show from near the area of this direct connection between the electrical cable CE and the conductive heating wire F, i.e. the electrical resistance R, integrated into the article 10.

Further Variants of the Heating Multilayer Article of the Invention

Of course, without prejudice to the basic principle and concepts of the present invention, the embodiments and construction details of the heating textile article, in the form of multilayer sheet, of the present invention, may be varied and subject to further modifications and improvements with respect to what has been described and illustrated up to here, without departing from the scope of the invention itself.

For example, in variants not represented in the drawings for reasons of brevity, some of the layers, described before, which form the multilayer structure of the heating fabric may be absent.

Still, as shown in FIGS. 8A and 8B, the electrical cable CE, which is connected to the heating fabric that is included in the heating article 10, besides being suitable to be connected with the electrical power supply, can be associated with a control box, indicated with SC, by which a user can control the electrical power which is supplied to the article 10 to generate heat.

Finally, in general, the textile article 10 of the invention and the respective heating fabric may advantageously be included, as heating elements, in a wider panel or multilayer structure.

Figure 8I:
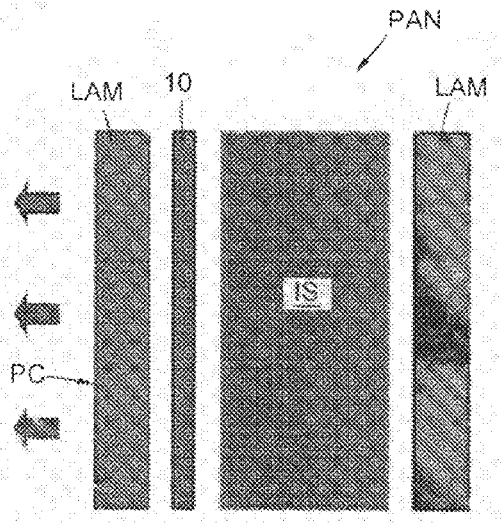
FIG. 8I is a diagram which shows the application of the heating article or fabric of the invention in a multilayer panel.

For example, with reference to FIG. 8I, the heating fabric 10 may be interposed between the plates and the layers of a multilayer panel, indicated as a whole with PAN, wherein the layers of which the panel PAN is composed can in turn comprise one or more layers of different materials, having in particular a function of thermal and/or sound insulation, as an insulating layer IS, and/or laminates LAM arranged on the inner and outer surface of the panel PAN, so as to define a hot wall PC, associated with the heating fabric 10, adapted to radiate heat towards the outside, as indicated by arrows in FIG. 8I.

The invention claimed is:

1. A heating multilayer textile article comprising at least one heating layer consisting of a fabric which incorporates in its textile structure, as electrical resistance adapted to be fed with an electric current to warm up and generate heat, an electrically conductive yarn or thread, wherein the fabric, forming said heating layer, is a special warp knitted fabric, defining a warp direction and a weft direction, of a "crochet" type, that is a fabric manufactured with a warp knitting machine or loom of the "crochet" type, wherein, in the manufacture of the fabric by means of said warp knitting machine, said electrically conductive yarn is used as effect yarn to realize a design of said electrical resistance according to a continuous serpentine form or a similar form in which the conductive yarn runs and extends both in the warp direction and in the weft direction of the knitted fabric, wherein said continuous serpentine form is defined by a plurality of first portions extending, in the warp direction, across a plurality of weft yarns, and by a plurality of second portions extending, in the weft direction, across a plurality of warp yarns of the knitted fabric manufactured by means of the warp knitting machine, and wherein said yarn, integrated in said textile heating layer and constituting said electrical resistance, is adapted to be powered and fed by a mains power supply via an electrical cable wherein the electrical cable is directly connected at one end with said yarn, without requesting provision of an electrode or a conductive band wherein the electrode or the conductive band extends laterally along one edge or an opposite edge of the fabric, and wherein, in a connection between said electrical cable and said yarn, a conductive cable of the electrical cable is inserted into a conductive fiber of the yarn.

2. The multilayer textile article according to claim 1, further comprising at least one reflective layer which is associated with and arranged adjacent to said heating layer to receive and reflect, towards a determined side of the textile article, the heat that is generated by the heating layer, wherein said reflective layer comprises a ceramic material and is constituted by a ceramic membrane.

3. The multilayer textile article according to claim 1, further comprising one or more electrically insulating layers, thereby made with an electrically insulating material suitable for protecting against moisture coming from outside and providing an electrical isolation, towards the outside, for the electric current passing through the heating layer of the textile article, wherein said one or more electrically insulating layers are constituted by a layer of polyurethane, whereas the heating multilayer article is expected to operate at relatively low temperatures, or are constituted by a fiber fabric of glass fibers or aramid fibers, whereas the heating multilayer article is expected to operate at medium or relatively high temperatures, and wherein said one or more electrically insulating layers of the multilayer textile article have or not anti-flame retardant properties, that is contain or not a material or an anti-flame substance suitable to delay a progress of a flame both in a case the flame comes from the outside of the article and in a case the flame is generated by the heating layer due to a too high a temperature.

4. The multilayer textile article according to claim 2, comprising at least one rear support layer arranged on a rear side of the textile article, wherein said rear support layer is constituted by a nonwoven fabric, and/or comprising at least one front support layer arranged on a front side, of the textile article, corresponding to said determined side for the transmission to the outside of the heat generated by the textile article, and wherein said front support layer is constituted by a nonwoven fabric, or by a warp and weft woven fabric.

5. The multilayer textile article according to claim 4, wherein the rear and/or the front support layer of nonwoven fabric or of warp and weft woven fabric is covered by a film, adapted to act as an electrical insulator along the front and/or rear side of the textile article.

6. The multilayer textile article according to claim 2, comprising, along said determined side for transmission to the outside of the heat generated by the textile article, a layer capable of emitting an infrared radiation when it is heated by the heat generated by said heating layer of the textile article.

7. Article or product manufactured by using a multilayer textile article according to claim 1, wherein said article or product is selected from a group consisting of a generic item of clothing such as a jacket, a heating cover for covering floors or similar structures, a tent, a vehicle that uses the textile article for heating and other products yet.

8. A process for the manufacture of a heating multilayer textile article including in its multilayer structure at least one heating layer which incorporates an electrical resistance adapted to be powered, by a mains power supply, with an electric current to generate heat, comprising at least the following steps:

manufacturing said heating layer in form of a fabric which incorporates in its textile structure, as electrical resistance, an electrically conductive yarn or thread, wherein said fabric constituting said heating layer is manufactured with a warp knitting machine or loom of a "crochet" type, using said conductive yarn, as effect yarn, to realize in the fabric a design of the electrical resistance according to a continuous serpentine shape or a similar form in which the conductive yarn runs and extends both in a warp direction and in a weft direction of the knitted fabric, and wherein said continuous serpentine form is defined by a plurality of first portions extending, in the warp direction, across a plurality of weft yarns, and by a plurality of second portions extending, in the weft direction, across a plurality of warp yarns of the knitted fabric manufactured by means of the warp knitting machine; and associating and joining said heating layer, formed by said fabric manufactured with said machine or loom of the "crochet" type, with other layers so as to form the final multilayer textile article;

wherein said yarn, integrated in said textile heating layer and constituting said electrical resistance, is adapted to be powered and fed by the mains power supply via an electrical cable wherein the electrical cable is directly connected at one end with said yarn, without requesting provision of an electrode or a conductive band wherein the electrode or the conductive band extends laterally along one edge or an opposite edge of the fabric, and wherein in a connection between said electrical cable and said yarn a conductive cable of the electrical cable is inserted into a conductive fiber of the yarn.

9. The process for the manufacture of a multilayer textile article according to claim 8, wherein said other layers, included in the multilayer structure of the final textile article, comprise at least one reflective layer which is arranged adjacent to said heating layer to receive and reflect toward a determined side of the textile article the heat generated by the heating layer.

10. The process according to claim 9, wherein said other layers, included in the multilayer structure of the final article, comprise a rear support layer arranged on a rear side of the textile article and consisting of a nonwoven fabric, and/or a front support layer arranged on a front side, of the textile article, corresponding to said determined side for transmission toward the outside of the heat generated by the textile article, and wherein said front support layer is constituted by a nonwoven fabric or by a warp and weft woven fabric.

11. The process according to claim 10, wherein said rear and/or front support layers of nonwoven fabric or warp and weft woven fabric are covered by a film of polyester adapted to act as an electrical insulator along the front and/or rear side of the textile article.

12. The multilayer textile article according to claim 1, wherein said electrically conductive yarn or thread, incorporated in the fabric of said at least one heating layer of the textile article, comprises carbon fibers.

13. The process for the manufacture of a multilayer textile article according to claim 8, wherein said electrically conductive yarn or thread, incorporated in the fabric of said at least one heating layer of the textile article, comprises carbon fibers.

14. The multilayer textile article according to claim 5, wherein said film is of polyester.

15. The process for the manufacture of a multilayer textile article according to claim 10, wherein said nonwoven fabric constituting said rear support layer and/or said front support layer is of polyester.

16. The multilayer textile article according to claim 3, wherein the anti-flame retardant properties of said one or more electrically insulating layers are conferred by an anti-flame substance containing phosphorus.

17. The multilayer textile article according to claim 4, wherein the nonwoven fabric constituting said rear support layer and/or said front support layer is of polyester.

18. The multilayer textile article according to claim 3, wherein said one or more electrically insulating layers of the multilayer textile article contain a material or an anti-flame substance suitable to delay a progress of a flame both in a case the flame comes from the outside of the article and in a case the flame is generated by the heating layer due to temperature.

* * * * *